US005251456A

United States Patent [19]

Nagao et al.

[11] Patent Number: 5,251,456

[45] Date of Patent: Oct. 12, 1993

[54] MULTI-STAGE COLD ACCUMULATION TYPE REFRIGERATOR AND COOLING DEVICE INCLUDING THE SAME

[75] Inventors: Masashi Nagao; Hideto Yoshimura; Takashi Inaguchi, all of Amagasaki, Japan

[73] Assignee: Mitsubishi Denki Kabushiki Kaisha, Tokyo, Japan

[21] Appl. No.: 890,264

[22] Filed: May 29, 1992

Related U.S. Application Data

[62] Division of Ser. No. 722,547, Jun. 26, 1991, Pat. No. 5,154,063, and Ser. No. 721,816, Jun. 26, 1991, Pat. No. 5,144,805, and Ser. No. 721,135, Jun. 26, 1991, Pat. No. 5,144,810, which is a division of Ser. No. 430,582, Nov. 1, 1989, Pat. No. 5,092,130.

[30] Foreign Application Priority Data

| | | | |
|---|---|---|---|
| Nov. 9, 1988 | [JP] | Japan | 284450 |
| Nov. 9, 1988 | [JP] | Japan | 284452 |
| Nov. 9, 1988 | [JP] | Japan | 284453 |
| Nov. 9, 1988 | [JP] | Japan | 284454 |
| Nov. 9, 1988 | [JP] | Japan | 284455 |
| Nov. 11, 1988 | [JP] | Japan | 285991 |

[51] Int. Cl.[5] ..... F25D 23/12

[52] U.S. Cl. ..... 62/259.2; 62/51.1; 361/699

[58] Field of Search ..... 62/47.1, 51.1, 259.2; 361/385

[56] References Cited

U.S. PATENT DOCUMENTS

| | | | |
|---|---|---|---|
| 3,119,236 | 1/1964 | Lutes | 62/3 |
| 3,364,675 | 1/1968 | Dorer | 62/6 |
| 3,375,867 | 4/1968 | Daunt . | |
| 3,477,729 | 11/1969 | Hershey . | |
| 3,523,574 | 8/1970 | Haskin . | |
| 4,082,138 | 4/1978 | Miedema et al. . | |
| 4,277,947 | 7/1981 | Durenec . | |
| 4,277,949 | 7/1981 | Lonsworth | 62/47.1 |
| 4,359,872 | 11/1982 | Goldowsky | 62/6 |
| 4,366,676 | 1/1983 | Wheatley et al. . | |
| 4,543,794 | 10/1985 | Matsutani et al. | 62/47.1 |
| 4,689,439 | 8/1987 | Sato | 62/51.3 |
| 4,689,970 | 9/1987 | Ohguma et al. . | |
| 4,691,534 | 9/1987 | Lombardini et al. | 62/55.5 |
| 4,712,388 | 12/1987 | Sullivan et al. | 62/51.1 |
| 4,805,420 | 2/1989 | Porter et al. | 62/51.1 |

FOREIGN PATENT DOCUMENTS

| | | |
|---|---|---|
| 0053784 | 6/1982 | European Pat. Off. . |
| 524795 | 8/1972 | Fed. Rep. of Germany . |
| 1551312 | 8/1976 | Fed. Rep. of Germany . |
| 3046458 | 7/1982 | Fed. Rep. of Germany . |
| 3427601 | 2/1985 | Fed. Rep. of Germany . |
| 2283414 | 3/1976 | France . |

OTHER PUBLICATIONS

IBM Technical Disclosure Bulletin #1227, vol. 18, No. 4, Sep. 1975; Rideout et al.

German Patent Appln. P 39 36 914.5-42, Mitsubishi Denki K.K., ML 2285, Translation of the Office Action dated Jan. 28, 1991.

R. W. Stuart et al., Operation and Application of a Three-Stage Closed-Cycle Regenerative Refrigerator in the 6.5°K Region, K-3, pp. 428-435.

K. H. J. Buschow et al., Extremely Large Heat Capacities Between 4 and 10 K, Cryogenics, May 1975, pp. 261-264.

*Primary Examiner*—Ronald C. Capossela

*Attorney, Agent, or Firm*—Oblon, Spivak, McClelland, Maier & Neustadt

[57] ABSTRACT

In a multi-stage cold accumulation type refrigerator including a compressor disposed at an ordinary temperature, a helium gas as a common operating fluid to be compressed by the compressor, and one or more expansion chambers and cold accumulators of different temperature levels; a cold accumulating member of the cold accumulators is formed of an alloy or compound containing a rare earth metal, so that the efficiency of the refrigerator can be improved. Further, a heat generation quantity due to sliding resistance of a seal is set to be smaller than a theoretical generated refrigeration quantity to be obtained on the assumption of isothermal expansion in the expansion chambers, so that the refrigerating capacity can be improved. The refrigerator is applied to a cooling device for cooling a superconducting magnet, SQUID, superconducting computer, infrared telescope, etc.

13 Claims, 20 Drawing Sheets

REFRIGERATING CAPACITY OF THREE-STAGE GM REFRIGERATOR

MULTI-STAGE COLD ACCUMULATION TYPE REFRIGERATOR AND COOLING DEVICE INCLUDING THE SAME

The present application is a divisional of Ser. Nos. 07/722,547, filed Jun. 26, 1991, now U.S. Pat. No. 5,154,063; Ser No. 07/721,816, filed Jun. 26, 1991, now U.S. Pat. No. 5,144,805; and Ser. No. 07/721,135, filed Jun. 26, 1991, now U.S. Pat. No. 5,144,810; each of which is, in turn, a divisional of Ser. No. 07/430,582, filed Nov. 1, 1989, issued Mar. 3, 1992 as U.S. Pat. No. 5,092,130.

BACKGROUND OF THE INVENTION

1. Field of the Invention

The present invention relates to a multi-stage cold accumulation type refrigerator and a cooling device utilizing the same.

2. Discussion of the Invention

FIG. 29 shows a conventional three-stage GM (Gifford-McMahon) refrigerator as a multi-stage cold accumulation type refrigerator as disclosed in Advances in Cryogenic Engineering Vol. 15, p428, 1969, for example. The refrigerator includes a third cold accumulator 1 having a cold accumulating member formed of lead balls, a second cold accumulator 2 having a cold accumulating member formed of lead balls, a first cold accumulator 3 having a cold accumulating member formed of copper wire net, a third displacer 4, a second displacer 5, a first displacer 6, a third seal 7 for preventing leakage of a helium gas 16 from an outer periphery of the third displacer 4, a second seal 8 for preventing leakaqe of the helium gas 16 from an outer periphery of the second displacer 5, a first seal 9 for preventing leakage of the helium gas 16 from an outer periphery of the first displacer 6, a three-stepped cylinder 10 formed from a honing pipe, a suction valve 11 for inducing the helium gas 16 compressed by a helium compressor 13, an exhaust valve 12 for exhausting the helium gas 16, a driving motor 15, a driving mechanism 14 for converting rotation of the driving motor 15 into a linear motion and operating the suction valve 11 and the exhaust valve 12 in synchronism with the linear motion, third, second and first expansion chambers 17, 18 and 19 for expanding the helium gas 16, a third thermal stage 20 for transmitting cold generated in the third expansion chamber 17 to a body to be cooled (not shown), a second thermal stage 21 for transmitting cold generated in the second expansion chamber 18 to the body, and a first thermal stage 22 for transmitting cold generated in the first expansion chamber 19 to the body.

The operation of the above refrigerator will now be described. FIG. 30 is a P-V diagram in the expansion chambers 17 to 19, wherein an axis of ordinate represents a pressure in the expansion chambers 17 to 19, and an axis of abscissa represents a volume of the expansion chambers 17 to 19. Under the condition as shown by (1), the displacers 4 to 6 are disposed as their uppermost positions, and the suction valve 11 is open, while the exhaust valve 12 is closed. Accordingly, the pressure in the expansion chambers 17 to 19 is a high pressure PH. When the condition is shifted from (1) to (2), the displacers 4 to 6 are lowered, and the helium gas 16 having a high pressure is induced through the cold accumulators 1 to 3 into the expansion chambers 17 to 19. During this operation, the valves 11 and 12 remain still. The helium gas 16 is cooled to predetermined temperatures by the cold accumulators 1 to 3. Under the condition at (2), the volume of each expansion chamber is maximum, and the suction valve 11 is closed, while the exhaust valve 12 is opened. At this time, the pressure of the helium gas 16 in each expansion chamber is reduced to generate cold, and the condition is shifted to (3). When the condition is shifted from (3) to (4), the displacers 4 to 6 are raised, and the helium gas 16 having a low pressure is exhausted. At this time, the helium gas 16 cools the cold accumulators 1 to 3, and the temperature of the helium gas 16 is increased. Then, the helium gas 16 is returned to the helium compressor 13. Under the condition at (4), the volume of each expansion chamber is minimum, and the exhaust valve 12 is closed, while the suction valve 11 is opened. As a result, the pressure in each expansion chamber is increased to restore the condition shown by (1).

In the multi-stage cold accumulation type refrigerator as mentioned above, the efficiency of the third cold accumulator is rapidly reduced, and temperature of 6.5 K or less can not be obtained because a specific heat of lead forming the cold accumulating member of the third cold accumulator is smaller temperature of 10 K or less, while a specific heat of helium gas is large.

Further, a generated refrigeration quantity becomes smaller than an indicated refrigeration quantity at a temperature of 4 K owing to a change in physical property of helium. Accordingly, there occurs a problem of heat generation due to sliding resistance of the seal.

Further, as the specific heat of the third heat stage becomes small at temperature of about 4 K, temperature oscillation in a refrigeration cycle is increased to cause a reduction in efficiency.

If the cold accumulating member in the conventional multi-stage cold accumulation type refrigerator is formed of an alloy or compound containing a rare earth metal (which alloy or compound will be hereinafter referred to as a rare earth substance), fine powder of the cold accumulating member is generated by vibration during operation, and is deposited to the seal portions, causing a reduction in sealing effect and an increase in friction between each displacer and the cylinder.

SUMMARY OF THE INVENTION

It is accordingly an object of the present invention to provide a multi-stage cold accumulating type refrigerator which improves the efficiency, temperature stability and reliability, and also provide various cooling devices utilizing such a refrigerator.

According to a first aspect of the present invention, there is provided in a multi-stage cold accumulation type refrigerator including a compressor disposed at an ordinary temperature, a helium gas as a common operating fluid to be compressed by said compressor, and one or more expansion chambers and cold accumulators of different temperature levels; the improvement wherein a cold accumulating member of said cold accumulators is formed of an alloy or compound containing a rare earth metal.

According to a second aspect of the present invention, there is provided in a multi-stage cold accumulation type refrigerator including a compressor disposed at an ordinary temperature, a helium gas as a common operating fluid to be-compressed by said compressor, and one or more expansion chambers and cold accumulators of different temperature levels; the improvement wherein a cold accumulating member of said cold accumulators is formed of two or more kinds of substances according to a temperature region where a large specific heat is obtained, and GdRh is used for the cold accumulating member at a high temperature level, while $Gd_{0.5}Er_{0.5}Rh$ is used for the cold accumulating member at a low temperature level, and a weight ratio of GdRh is set to 45–65%.

According to a third aspect of the present invention, there is provided in a multi-stage cold accumulation type refrigerator including a compressor disposed at an ordinary temperature, a helium gas as a common operating fluid to be compressed by said compressor, and one or more expansion chambers and cold accumulators of different temperature levels; the improvement comprising a seal for preventing leakage of said helium gas, wherein a heat generation quantity due to sliding resistance of said seal is set to be smaller than a theoretical generated refrigeration quantity to be obtained on the assumption of isothermal expansion in said expansion chambers.

According to a fourth aspect of the present invention, there is provided in a multi-stage cold accumulation type refrigerator including a compressor disposed at an ordinary temperature, a helium gas as a common operating fluid to be compressed by said compressor, and one or more expansion chambers and cold accumulators of different temperature levels; the improvement comprising a cylinder, a seal for preventing leakage of said helium gas, a thermal anchor mounted on an outer surface of said cylinder at a position where said seal is slid, said thermal anchor being formed of a good heat conductor and thermally connected to a high-temperature thermal stage so as to absorb heat generation due to sliding resistance of said seal.

According to a fifth aspect of the present invention, there is provided in a multi-stage cold accumulation type refrigerator including a compressor disposed at an ordinary temperature, a helium gas as a common operating fluid to be compressed by said compressor, and one or more expansion chambers and cold accumulators of different temperature levels; the improvement wherein a cold accumulating member formed of an alloy or compound containing a rate earth metal having a large specific heat at a temperature region of 10 K or less or a container for containing helium is mounted to an end of a cylinder, thermal stage or displacer disposed at said temperature region, so as to reduce a temperature change in a refrigeration cycle.

Other objects and features of the invention will be more fully understood from the following detailed description and appended claims when taken with the accompanying drawings.

DETAILED DESCRIPTION OF THE PREFERRED EMBODIMENTS

Figure 1:
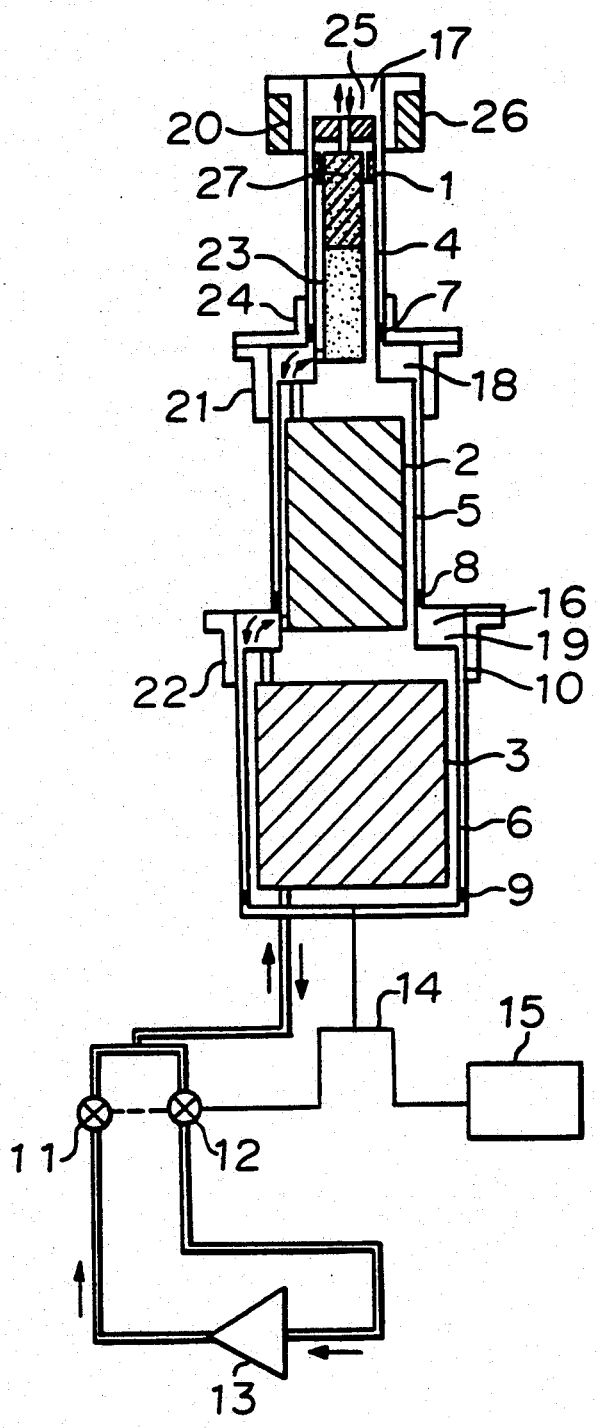
FIG. 1 is a vertical sectional view of a preferred embodiment of the three-stage GM refrigerator according to the present invention.

Referring to FIG. 1, the three-stage Gifford-McMahon cycle refrigerator (which will be hereinafter referred to as GM refrigerator) includes a low-temperature section 1 of a third cold accumulator, a high-temperature section 23 of the third cold accumulator, a thermal anchor 24 mounted on an outer surface of a cylinder 10 at a seal sliding portion, an internal uniform heating cold accumulating member 25 mounted on an end of a third displacer 4, an external uniform heating cold accumulating member 26 mounted to a third thermal stage 20, and a trapping magnet 27.

Figure 5A:
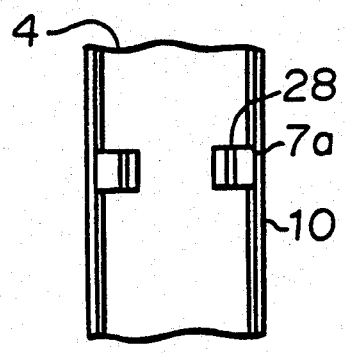
FIGS. 5A and 5C are enlarged sectional views of different types of the seal portion in the refrigerator.
Figure 5B:
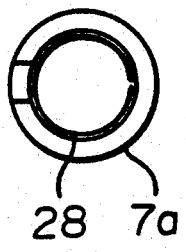
FIG. 5B is a cross section taken along the line A—A in FIG. 5A.
Figure 5C:
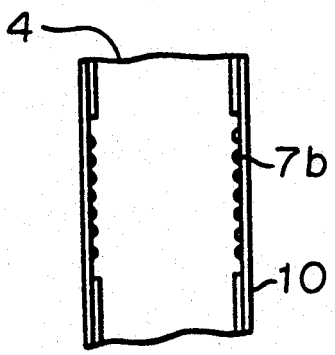

Referring to FIGS. 5A and 5C, reference numeral 28 denotes a tension ring of a piston ring **7*a* as a preferred embodiment of a third seal 7, and reference numeral 7*b* denotes a labyrinth seal as another preferred embodiment of the third seal 7**.

Figure 7:
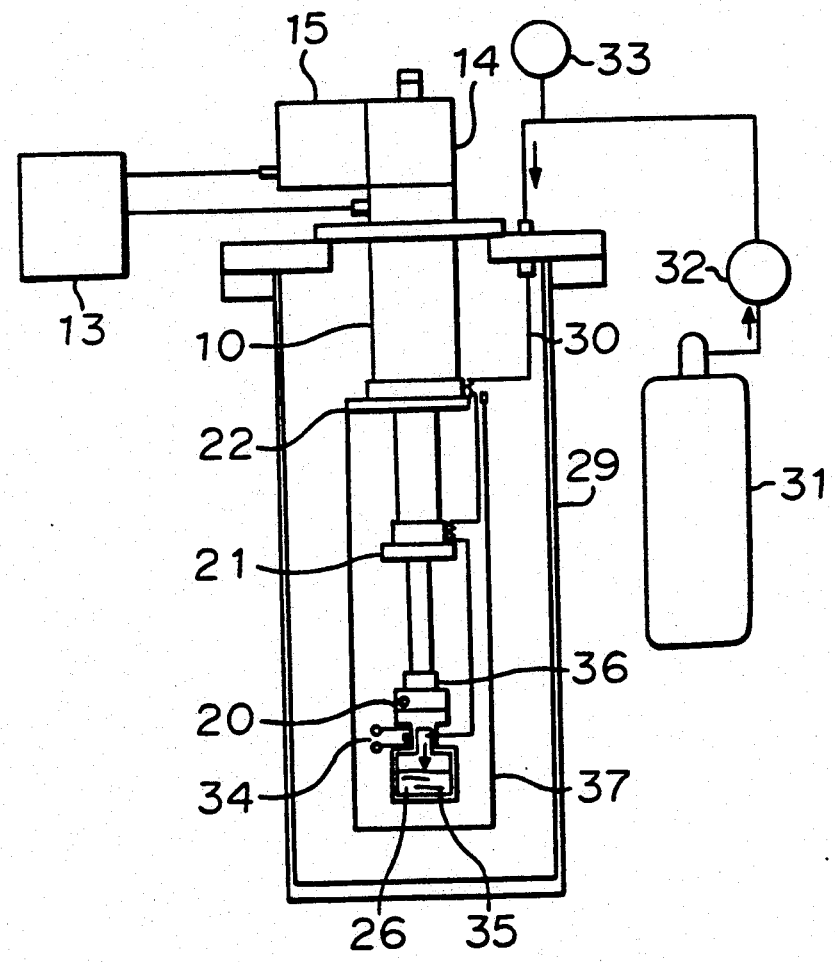
FIG. 7 is a schematic illustration of an experimental system in the preferred embodiment.

Referring to FIG. 7, the experimental system includes a vacuum tank 29 for heat insulation, a helium conduit 30, a helium cylinder 31, a pressure reducing valve 32 for reducing a pressure of the helium gas from the helium cylinder 31, a manometer 33, a heater 34 mounted to a helium tank used as the external uniform heating cold accumulating member, a liquid helium 35, a temperature sensor 36 and a radiation shield 37.

Figure 9:
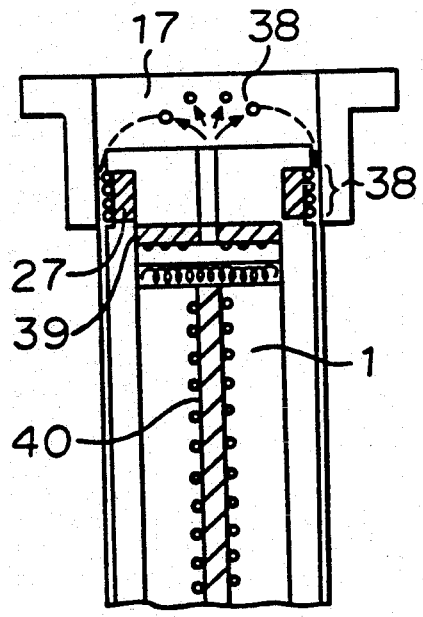
FIG. 9 is an enlarged-sectional view of the trapping magnets for trapping fine powder of the cold accumulating member.

Referring to FIG. 9, reference numerals 38, 39 and 40 denote a fine powder of the cold accumulating member, a trapping magnet II provided at an outlet of the cold accumulator, and a trapping magnet III provided at a center of the cold accumulator.

Figure 2:
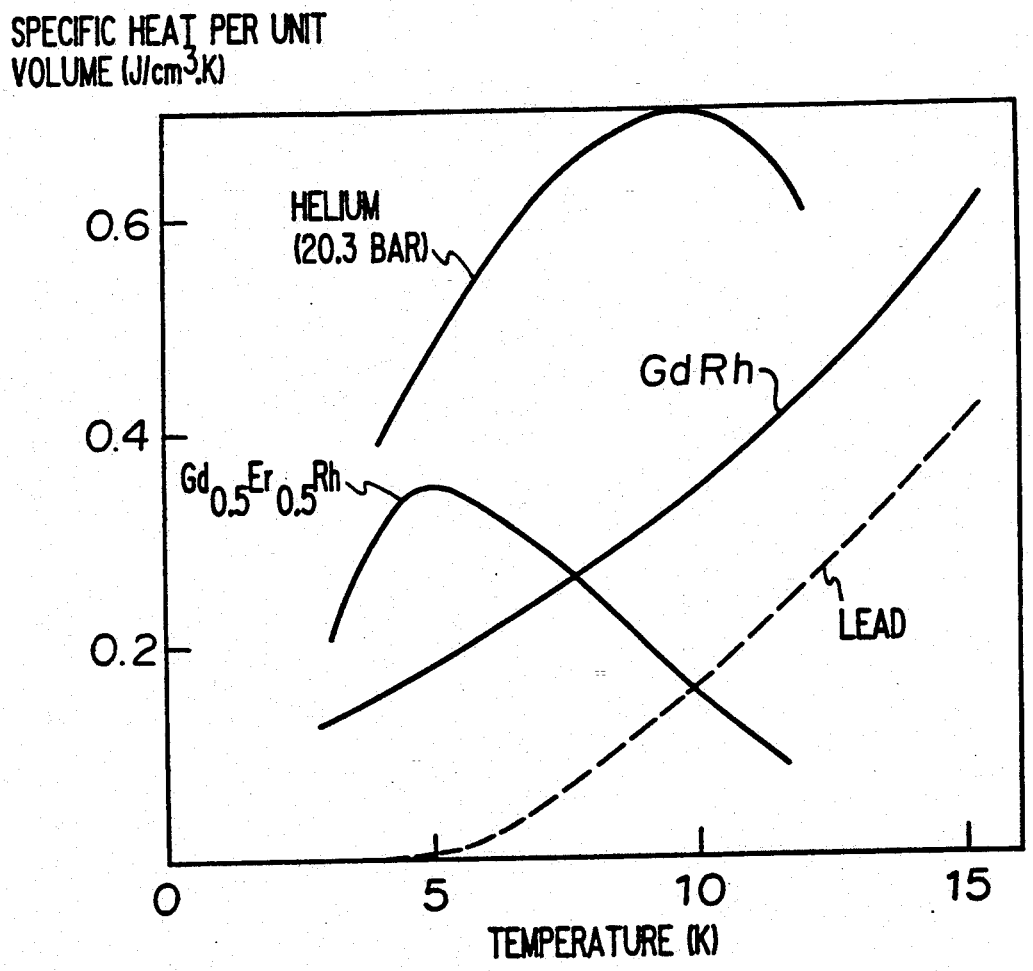
FIG. 2 is a characteristic graph of the specific heat of the cold accumulating member to be used in the refrigerator with respect to a temperature change.

In the multi-stage cold accumulation type refrigerator as constructed above, the cold accumulating member of the low-temperature section 1 and the high-temperature section 23 of the third cold accumulator is formed of a rare earth substance having a large specific heat at low temperature of 10 K or less, so as to improve the efficiency as the cold accumulator. FIG. 2 shows specific heats per unit volume of lead, rare earth substances (e.g. GdRh and $Gd_{0.5}Er_{0.5}Rh$) and 20 bar helium. In the refrigerator shown in FIG. 1, the helium gas compressed to about 20 bar, for example, is refrigerated to 40 K in a first cold accumulator 3, and is then refrigerated to 11 K in a second cold accumulator 2, and is then further refrigerated in the third cold accumulator 1 to be introduced into a third expansion chamber 17. If lead is used for the cold accumulating member of the third cold accumulator 1, the helium gas is not sufficiently refrigerated since the specific heat of lead is smaller than that of the helium gas as apparent from FIG. 2. Accordingly, temperature in the third expansion chamber 17 is increased to generate a loss. In contrast, if GdRh is used for the cold accumulating member, the loss can be reduced to thereby lower an attainable temperature since the specific heat of GdRh is larger than that of lead as apparent from FIG. 2.

Figure 3:
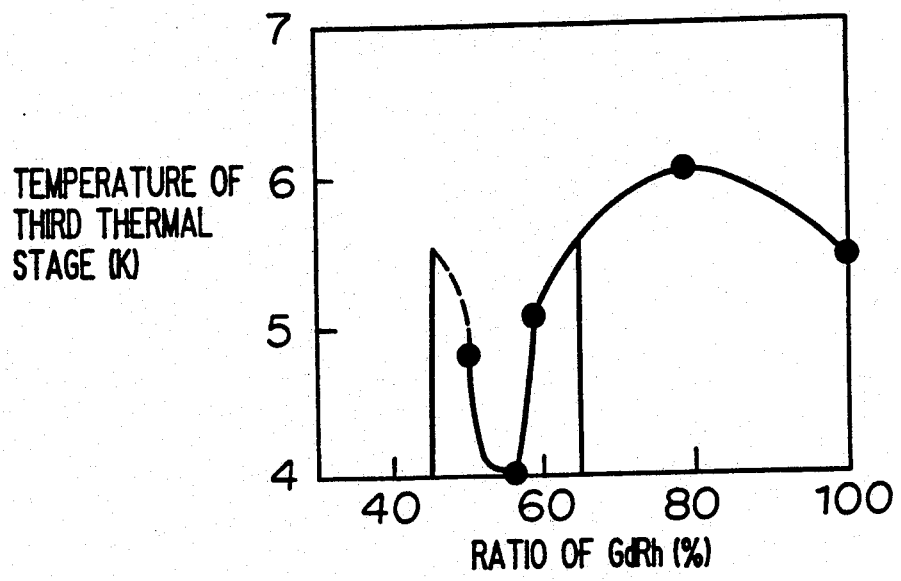
FIG. 3 is a characteristic graph of the temperature of the third thermal stage in the refrigerator with respect to a change in ratio of GdRh.
Figure 4:
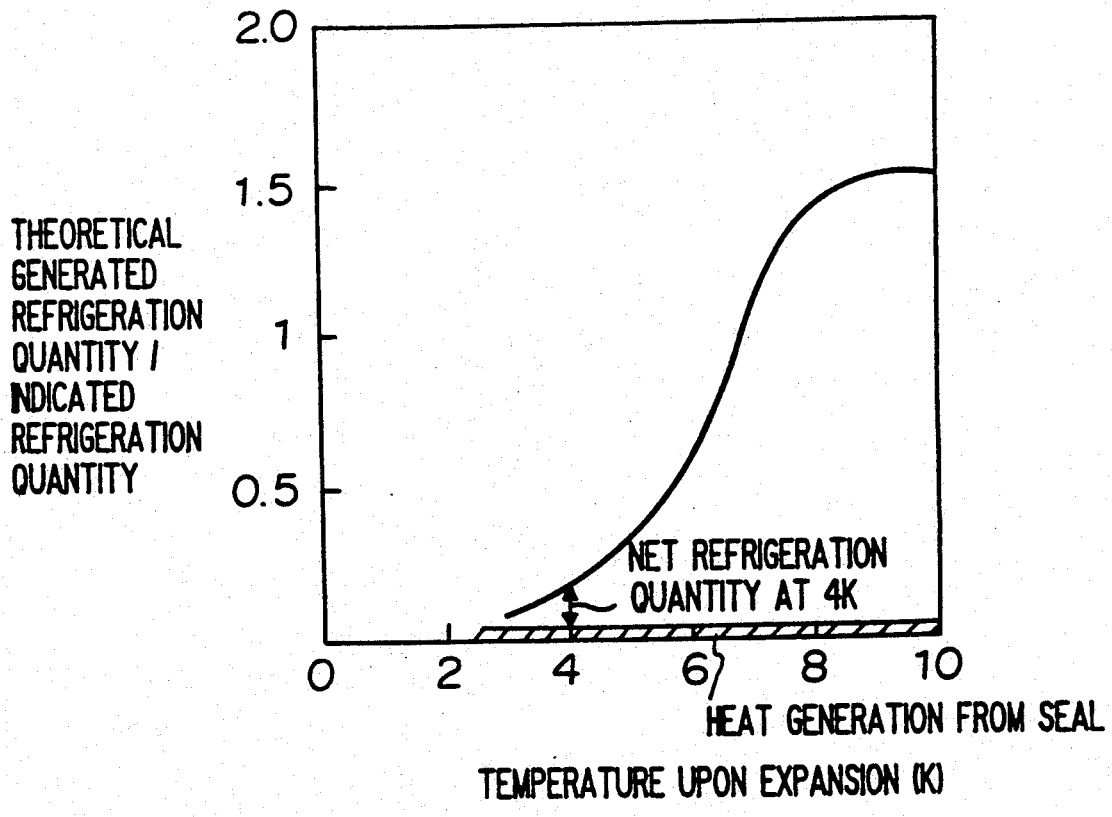
FIG. 4 is a characteristic graph of the theoretical generated refrigeration quantity with respect to a temperature change.

As the result of a comparative test using lead and GdRh for the cold accumulating member of the third cold accumulator 1, the attainable temperature in the case of lead was 6.5 K, while it was 5.5 K in the case of GdRh. As apparent from FIG. 2, the specific heat of GdRh is relatively large in the range of 20 K to 7.5 K, while the specific heat of $Gd_{0.5}Er_{0.5}Rh$ is relatively large in the range of 7.5 K or less. Accordingly, the efficiency can be more improved by using GdRh for the high-temperature section 23 of the third cold accumulator and using $Gd_{0.5}Er_{0.5}Rh$ for the low-temperature section 1 of the third cold accumulator. FIG. 3 shows a change in the attainable temperature with a change in ratio between $Gd_{0.5}Er_{0.5}Rh$ and GdRh. As apparent from FIG. 3, the attainable temperature can be lowered by setting the weight ratio of GdRh to 45–65%. FIG. 4 shows a change in generated refrigeration quantity with a temperature change, assuming isothermal change. A pressure range is from 20 bar at a high pressure to 6 bar at a low pressure. The generated refrigeration quantity is made dimensionless by an indicated refrigeration quantity. If the temperature is high, the helium gas 16 would be regarded as an ideal gas, and the generated refrigeration quantity made dimensionless would be substantially 1. However, as apparent from FIG. 4, the generated refrigeration quantity is suddenly lowered in the temperature region of 7 K or less. Such a point has not been clarified in the conventional multi-stage cold accumulation type refrigerator, causing a problem of heat generation due to sliding resistance from a large pressure of the third seal 7.

Figure 6:
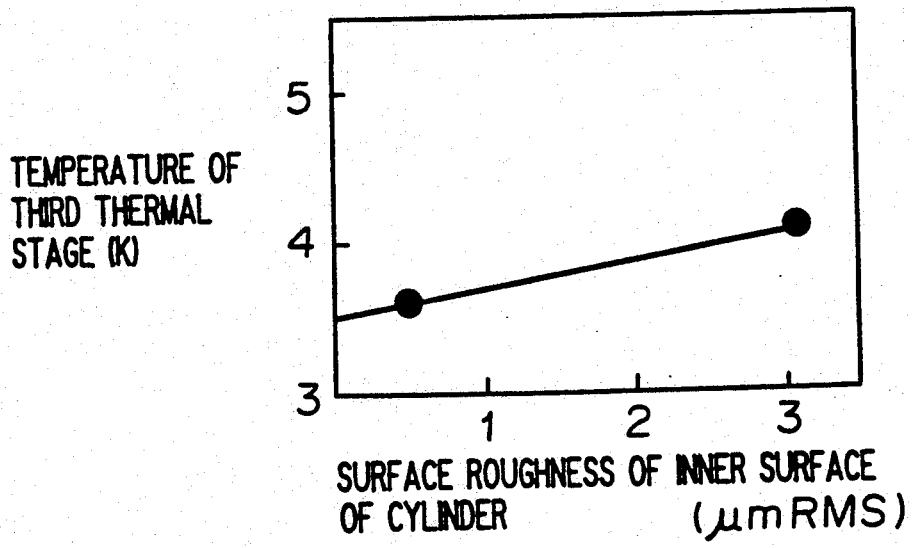
FIG. 6 is a characteristic graph of the temperature of the third thermal stage with respect to a change in surface roughness of the inner surface of the cylinder.

FIGS. 5A and 5B show a structure of the third seal 7*a* of a piston ring type. The piston ring 7*a* is radially outwardly pressed by the tension ring 28 to thereby tightly contact an outer circumferential surface of the piston ring 7*a* with an inner circumferential surface of the cylinder 10 and prevent pass of the helium gas 16. The larger the elastic force of the tension ring 28, the more tightly both the circumferential surfaces contact to more improve the sealability. However, as the pressure of the piston ring 7*a* becomes larger, the sliding resistance of the seal is increased to cause an increase in heat generation. Conventionally, since the generated refrigeration quantity has been considered to be equal to the indicated refrigeration quantity, the pressure of the tension ring 28 has been excessive. To the contrary, according to the present invention, the generated refrigeration quantity is calculated to select the elastic force of the tension ring 28 so as to reduce the leakage of the helium gas and generate refrigeration. For example, when the sliding resistance was set to be 4% of the indicated refrigeration quantity, an improved sealability was obtained. On the other hand, a quantity of leakage of the helium gas is dependent on a surface roughness of the inner circumferential surface of the cylinder 10. FIG. 6 shows a relationship between the surface roughness of the inner surface of the cylinder 10 and the attainable temperature of the third thermal stage 20. When the surface roughness of the inner surface of the cylinder 10 was set to 0.5 μm RMS, the attainable temperature was 3.68 K.

FIG. 5C shows a preferred embodiment using the third seal 7*b* of a labyrinth type. A clearance between an outer circumferential surface of the labyrinth seal 7*b* and an inner circumferential surface of the cylinder 10 is made very small to thereby increase the resistance upon passing of the helium gas 16 therethrough and reduce the quantity of the helium gas 16 passing therethrough. Furthermore, as the sliding resistance of the labyrinth seal 7*b* is small, the heat generation can be reduced.

The internal uniform heating cold accumulating member 25 shown in FIG. 1 is formed of a rare earth substance such as ErRh and $ErNi_2$ having a large specific heat at very low temperatures, so as to increase a heat capacity of the cold generating section. As a result, a temperature change in a refrigeration cycle can be reduced, and the efficiency can be improved.

The external uniform heating cold accumulating member 26 can also exhibit the same effect as above. The external uniform heating cold accumulating member 26 may be formed from a helium tank instead of the rare earth substance as mentioned above.

Figure 8:
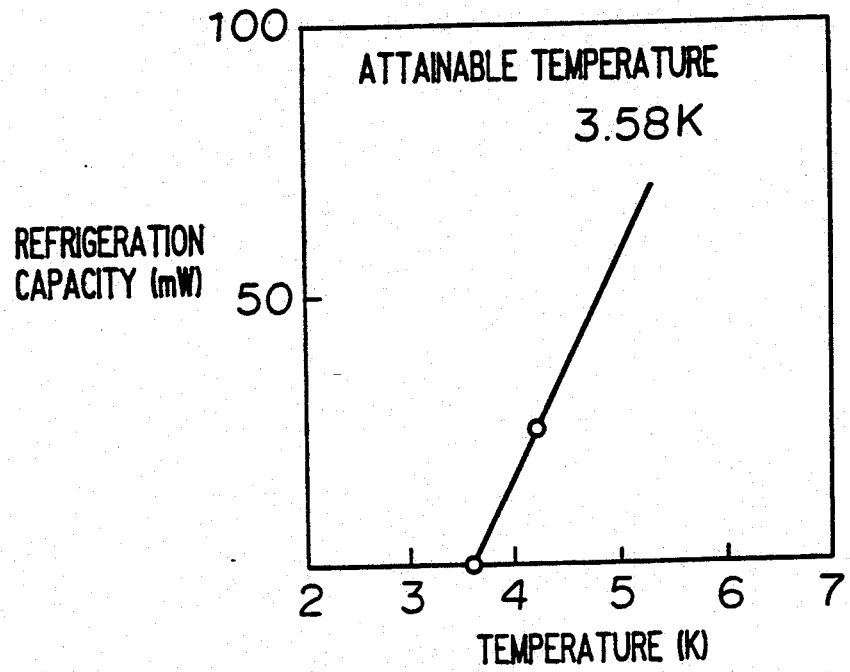
FIG. 8 is a characteristic graph of the refrigerating capacity with respect to a temperature change.

FIG. 7 is a schematic illustration of an experimental system constructed for the purpose of providing the above-mentioned effect of the present invention. A low-temperature section of the refrigerator is accommodated in the vacuum tank 29 thermally insulated under vacuum. The radiation shield 37 serves to reduce heat penetration due to radiation to the low-temperature section. The helium gas in the helium cylinder 31 is reduced in pressure to about atmospheric pressure by the pressure reducing valve 32, and is introduced through the helium conduit 30 to the helium tank 26. The heater 34 serves to heat the third thermal stage 20, and the temperature sensor 36 serves to detect the temperature of the third thermal stage 20. As the result of the test carried out by using the above-mentioned experimental system, the inventors could liquefy the helium gas solely by the GM refrigerator for the first time in the world. FIG. 8 shows a refrigerating capacity of this refrigerator. As apparent from FIG. 8, the attainable temperature is 3.58 K, which temperature is greatly lower than a currently recorded temperature 6.5 K.

Generally, the rare earth substance is brittle, and when it is used for a long period of time, there is generated the fine powder 38 of the cold accumulating member as shown in FIG. 9, and the fine powder 38 is expelled into the third expansion chamber 17 to deposit onto the seal portion, causing an increase in leakage. The rare earth substance to be used for the cold accumulating member is almost made into a ferromagnetic material in a usable temperature region. According to the present invention, the trapping magnet 27 is provided to adsorb the fine powder 38 made ferromagnetic, so that the seal portion is not affected by the fine powder 38. The trapping magnet 39 is provided at the outlet of the third cold accumulator 1, so as to suppress the fine powder 38 from being expelled. Similarly, the trapping magnet 40 is provided at the center of the third cold accumulator 1, so as to suppress the fine powder 38 from being expelled.

Figure 10:
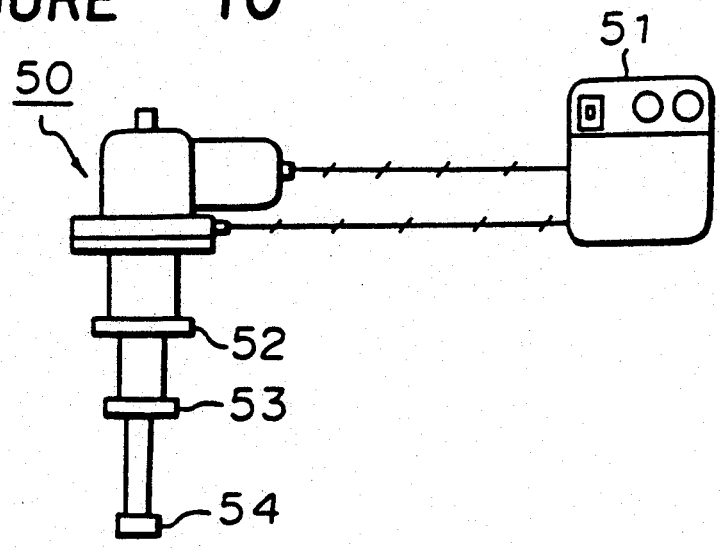
FIG. 10 is a schematic illustration of the three-stage GM refrigerator to be used in the present invention.
Figure 11:
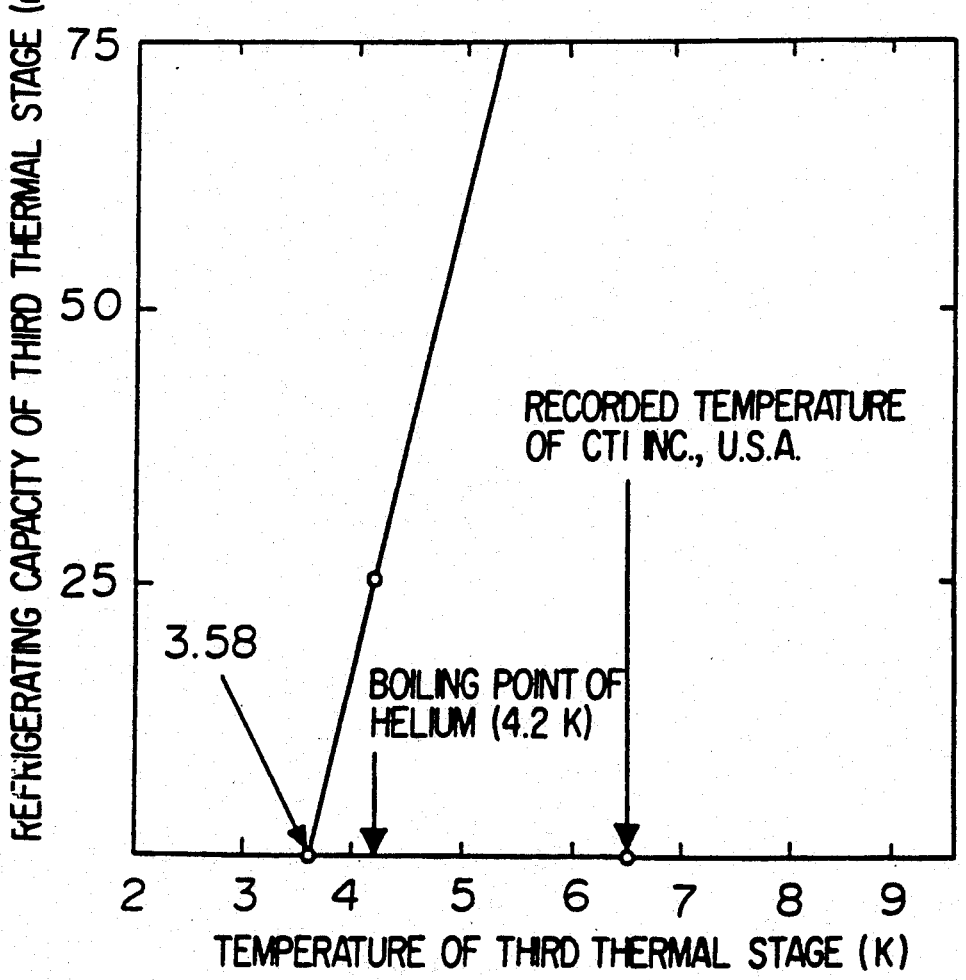
FIG. 11 is a characteristic graph of the refrigerating capacity of the refrigerator shown in FIG. 10 with respect to a temperature change.

FIG. 10 is a schematic illustration of a three-stage GM refrigerator utilizing the present invention, and FIG. 11 shows a refrigerating capacity of this refrigerator. As apparent from FIG. 11, it is possible to obtain temperatures less than 4.2 K which is a boiling point of helium. Referring to FIG. 10, reference numerals 50 and 51 denote the three-stage GM refrigerator and a compressor, respectively, and reference numerals 52, 53 and 54 denotes first, second and third heat stages, respectively.

Although the above-mentioned preferred embodiment is applied to a three-stage GM refrigerator, the present invention may be applied to two-stage or four or more-stage GM refrigerator which can exhibit a similar effect. Further, the present invention may be, of course, applied to any other refrigerators utilizing Solvay cycle, improved Solvay cycle, Vilmier cycle, Stirling cycle, etc.

In summary, the present invention can exhibit the following various effects.

(1) As the cold accumulating member of the cold accumulator is formed of a rare earth substance, a high efficiency of the refrigerator in a very low temperature region can be obtained.

(2) As the quantity of heat generation due to the sliding resistance of the seal is set to be smaller than the theoretical generated refrigeration quantity, a refrigerating capacity can be improved.

(3) As the thermal anchor is mounted on the outer surface of the seal sliding portion of the cylinder, and it is thermally connected to the high-temperature thermal stage, the heat generation due to the sliding resistance of the seal can be absorbed to thereby improve the refrigerating capacity.

(4) As the third thermal stage is mounted at the end of the displacer, and the uniform heating cold accumulating member is mounted at the end of the cylinder, temperature oscillation can be reduced, and the efficiency can be improved.

(5) As the trapping magnet for adsorbing a fine powder of the cold accumulating member is mounted to the displacer, it is possible to suppress the fine powder from affecting the seal portion or the like, thereby improving the reliability for a long period of time.

Figure 12:
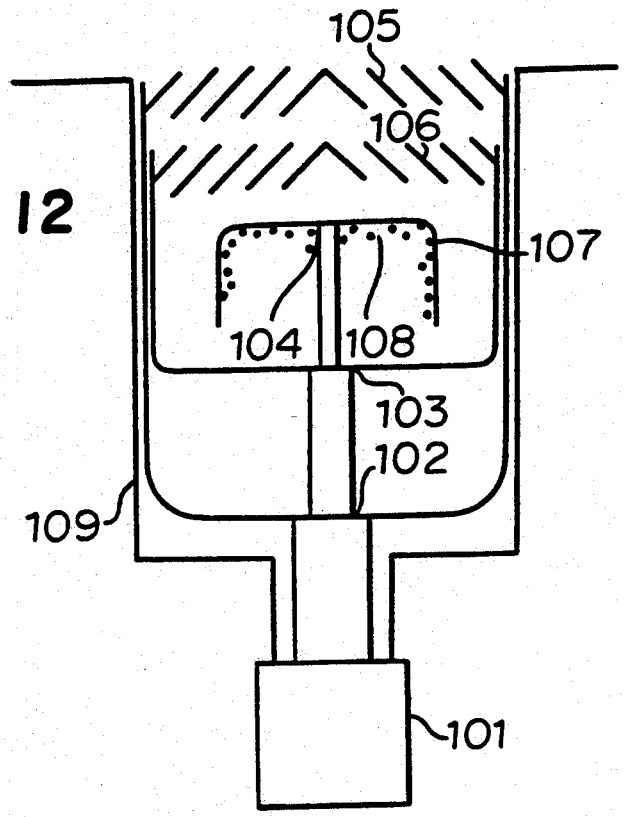
FIG. 12 is a schematic illustration of a preferred embodiment of the cryopump according to the present invention.

Referring next to FIG. 12 which shows a preferred embodiment of a cryopump utilizing the multi-stage cold accumulation type refrigerator according to the present invention, reference 101 designates a three-stage GM refrigerator having a refrigerating capacity such that an attainable temperature is 4.2 K or less. A cold accumulating member of a third cold accumulator in this refrigerator is formed on GdRh and $Gd_{0.5}Er_{0.5}Rh$. The refrigerator 101 includes a first heat stage 102, a second heat stage 103, a third heat stage 104, a first panel 105 mounted to the first heat stage 102, a second panel 106 mounted to the second heat stage 103, a third panel 107 mounted to the third heat stage 104, an active carbon 108 deposited on the third panel 107, and a vacuum container 109.

The first panel 105, the second panel 106 and the third panel 107 are refrigerated by the first heat stage 102, the second heat stage 103 and the third heat stage 104, respectively. The first heat stage 102 is operated at temperatures of about 50 K to refrigerate the first panel 105 functioning to shield radiation to the second panel 106. When steam strikes against the cryopump, it is frozen on the first panel 105. The second heat stage 103 is operated at temperatures of about 15 K to refrigerate the second panel 106 functioning to shield radiation to the third panel 107. On the second panel 106 are frozen nitrogen, oxygen and argon. The third heat stage 104 is operated at temperatures of about 4 K to refrigerate the third panel 107 on which Ne and $H_2$ are frozen. The active carbon 108 deposited on the inside surface of the third panel 107 serves to adsorb He which is not frozen at temperatures of about 4 K.

Figure 13:
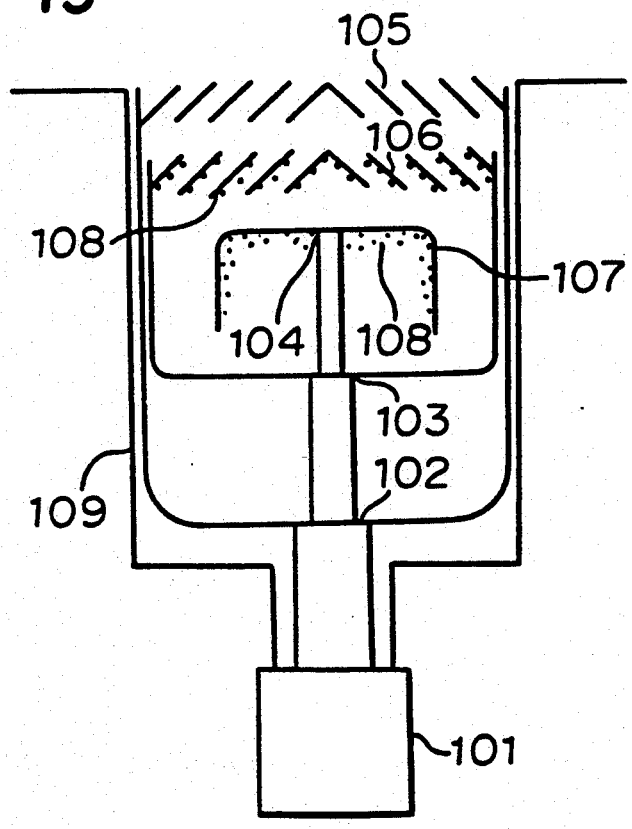
FIG. 13 is a view similar to FIG. 12, showing another preferred embodiment of the cryopump.

FIG. 13 shows another preferred embodiment of the cryopump as mentioned above, wherein the same reference numerals as in FIG. 12 denote the same or corresponding parts. In this preferred embodiment, the active carbon 108 is deposited on both the second panel 106 and the third panel 107, so that an operation load of the active carbon 108 on the third panel 107 may be reduced.

As mentioned above, the cryopump according to the present invention employs a multi-stage cold accumulation type refrigerator having plural heat stages and capable of obtaining an attainable temperature of 4.2 K or less. Therefore, $H_2$ and Ne can be frozen even without the active carbon, and an adsorption quantity by the active carbon can be increased by lowing the temperature of the active carbon.

FIGS. 14 to 17 show some preferred embodiments of a superconducting magnet cooling device utilizing the refrigerator according to the present invention, wherein the same reference numerals throughout the drawings denote the same or corresponding parts.

Figure 14:
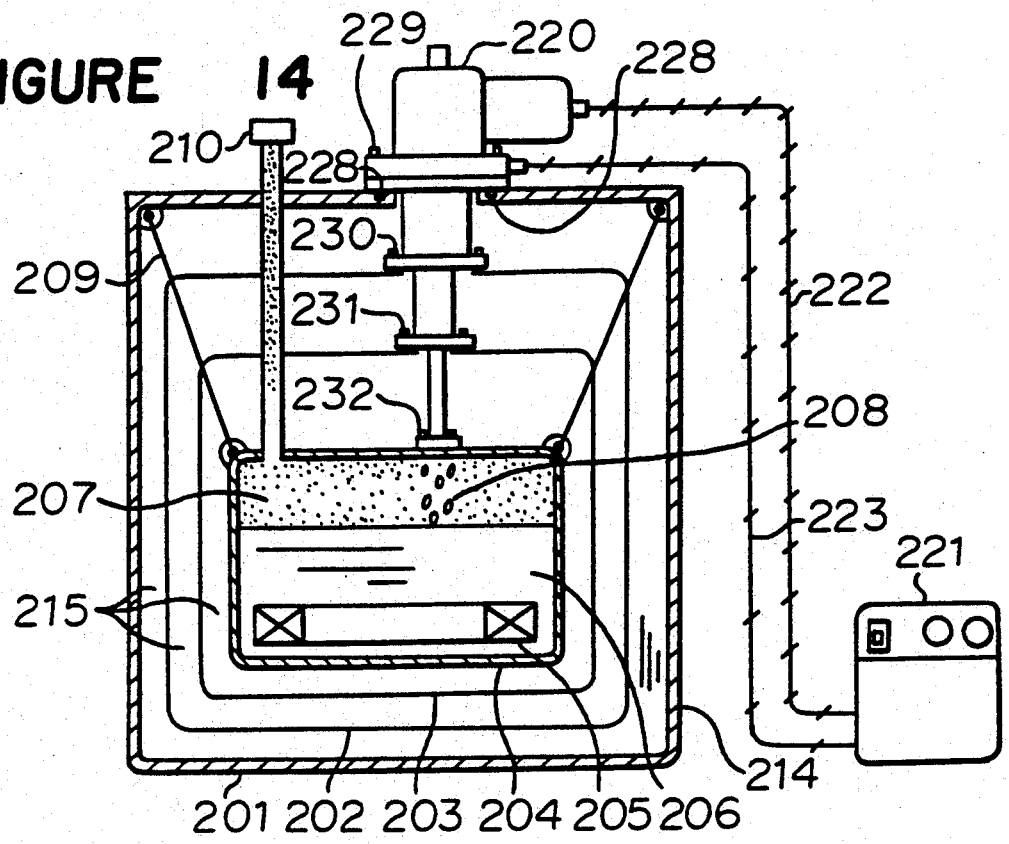
FIG. 14 is a sectional view of a preferred embodiment of the superconducting magnet cooling device according to the present invention.

Referring first to FIG. 14, the cooling device includes a vacuum tank 201 for a superconducting magnet 205, a first radiation heat shield 202, a second radiation heat shield 203, a helium tank 204 for accommodating the superconducting magnet 205, a liquid helium 206 for cooling the superconducting magnet 205, a vaporized gas 207 of the liquid helium 206, liquid drops 208 generated by re-cooling the vaporized gas 207, a supporting device 209 for supporting the helium tank 204 so as to be thermally insulated from the vacuum tank 201, a port 210 communicated with the helium tank 204, a vacuum section 215 for heat insulation, a multi-layer heat insulator 214 for heat insulation, a three-stage GM refrigerator 220, set screws 230 for connecting the first radiation heat shield 202 to a first heat stage of the three-stage GM refrigerator 220, set screws 231 for connecting the second radiation heat shield 203 to a second heat stage of the GM refrigerator 220, set screws 232 for connecting the helium tank 204 to a third heat stage of the GM refrigerator 220, bolts 229 for connecting the GM refrigerator 220 to the vacuum tank 201, a gasket 228 for vacuum sealing, a compressor 221 for compressing a helium gas, a high-pressure hose 222 for supplying the high-pressure compressed helium gas to the GM refrigerator 220, and a low-pressure hose 223 for returning the low-pressure helium gas expanded in the GM refrigerator 220 to the compressor 221.

The third heat stage of the three-stage GM refrigerator 220 is mounted to the helium tank 204 by the set screws 232 in such a manner as to make thermal resistance as small as possible. The cold generated by the third heat stage is transmitted through a partition wall of the helium tank 204 to the vaporized gas in the helium tank 204, so as to re-liquefy the vaporized gas.

The first heat stage and the second heat stage of the GM refrigerator 220 are mounted to the first radiation heat shield 202 and the second radiation heat shield 203, respectively, so as to cool the shields 202 and 203 to about 80 K and about 20 K, respectively.

Figure 15:
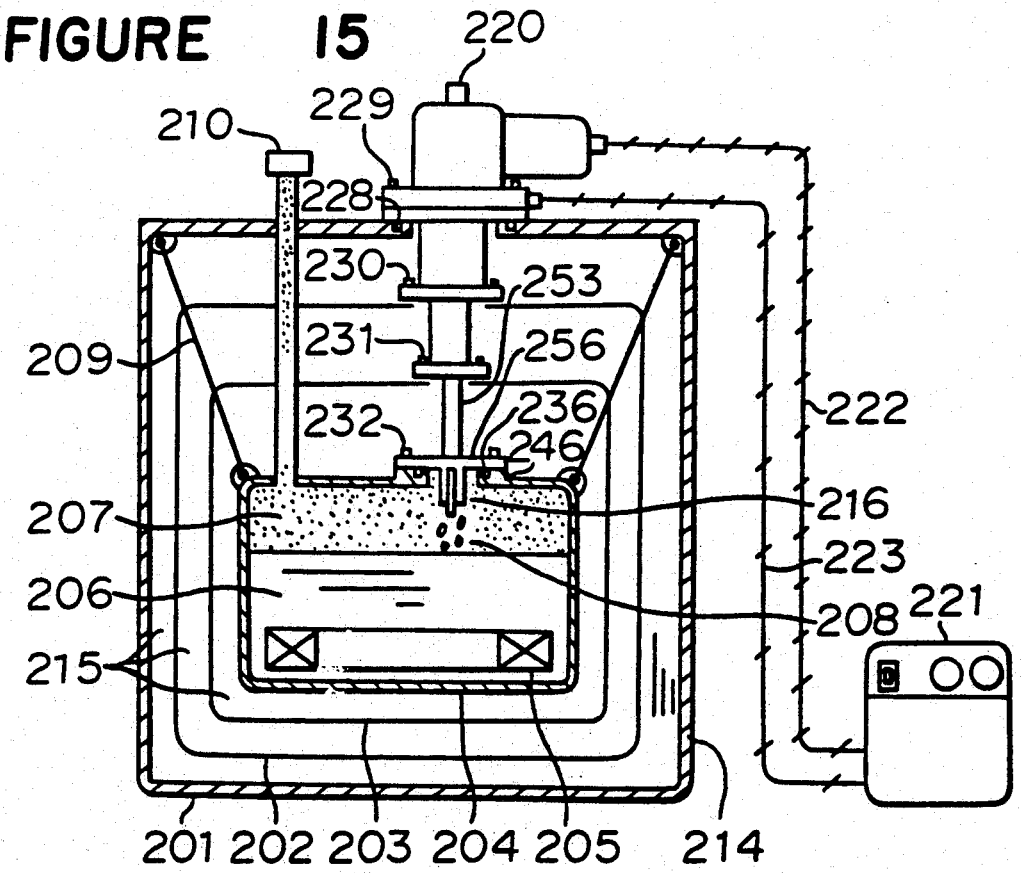
FIGS. 15, 16 and 17 are views similar to FIG. 14, showing various modifications of the superconducting magnet cooling device.

Although the cold generated by the third heat stage is transmitted through the partition wall of the helium tank 204 to the vaporized gas in the above preferred embodiment, the third heat stage may be exposed into the helium tank 204 as shown in FIG. 15. In this case, a gasket 236 for vacuum sealing is necessary.

Figure 16:
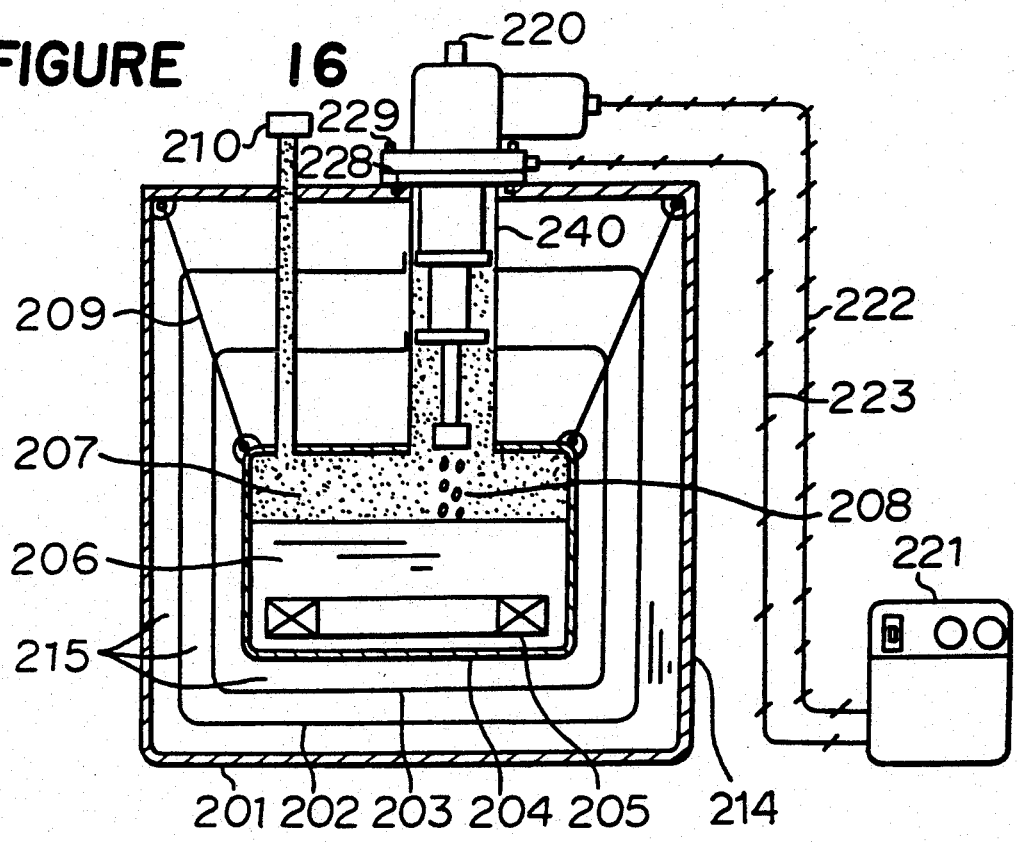
Figure 17:
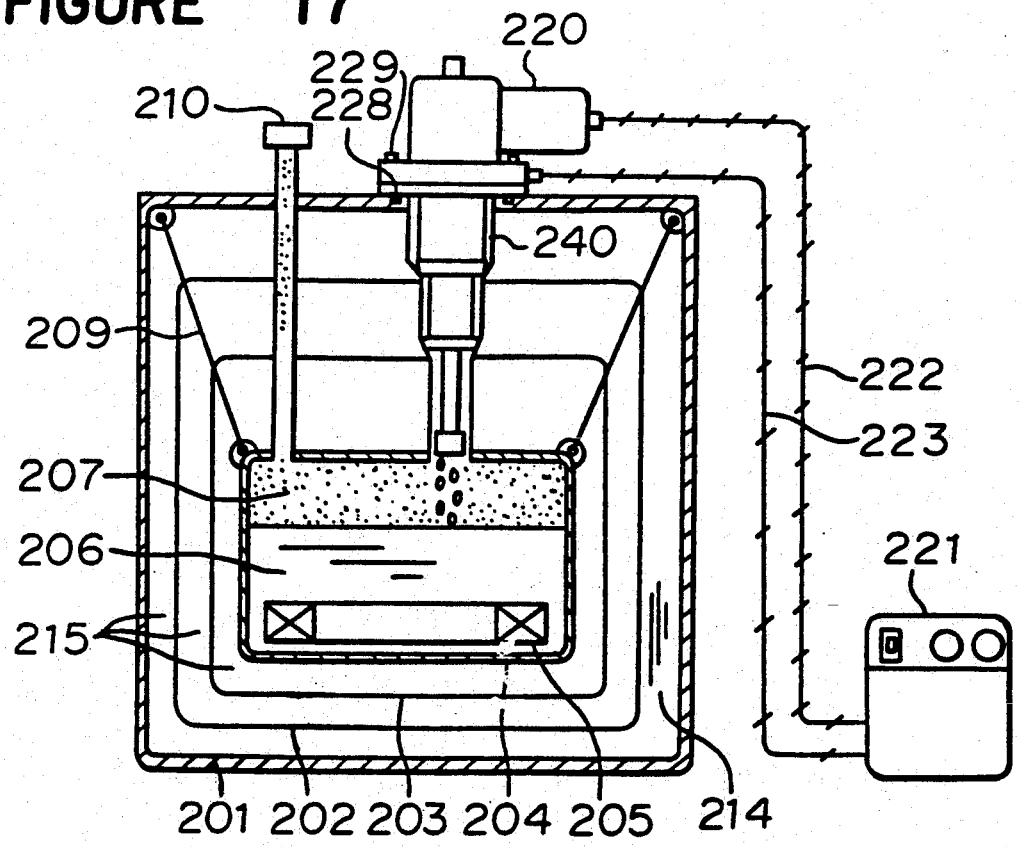

FIG. 16 shows a modification of the above preferred embodiment, wherein a port 240 for inserting the GM refrigerator 220 is provided. The vaporized gas is reliquefied by the third heat stage, and the radiation heat shields are cooled by the first heat stage and the second heat stage through a partition wall of the port 240. Alternatively, as shown in FIG. 7, the port 240 may be formed into a multi-step structure, so as to enhance thermal contact between the heat stages and the radiation heat shields.

Although the above-mentioned preferred embodiments are applied to a superconducting magnet for MRI, the present invention may be applied to other superconducting magnets having a refrigerating load of several watts at 4.2 K such as a superconducting magnet for magnetic levitation and a superconducting magnet for accelerators.

In the conventional cooling device for a superconducting magnet (e.g. the cooling device for a superconducting magnet for MRI as shown in the 1st Cryogenic Engineering Summe, Seminar Text (1988) p14 published by Cryogenic Engineering Association and the 34th Cryogenic Engineering Seminar Text (1985) p88 published by Cryogenic Engineering Association), a helium liquefier includes a heat exchanger and a Joule-Thomson valve. Therefore, such a cooling device is complex in structure and high in cost. Furthermore, the performance thereof is apt to be deteriorated, resulting in low reliability.

To the contrary, according to the present invention, the multi-stage cold accumulation type refrigerator capable of attaining temperatures of 4.2 K or less is combined with a superconducting magnet, so as to reliquefy the helium gas vaporized and simultaneously cool the radiation heat shields. Accordingly, the structure of the cooling device according to the present invention can be simplified at low costs, and the reliability can be improved.

Figure 19:
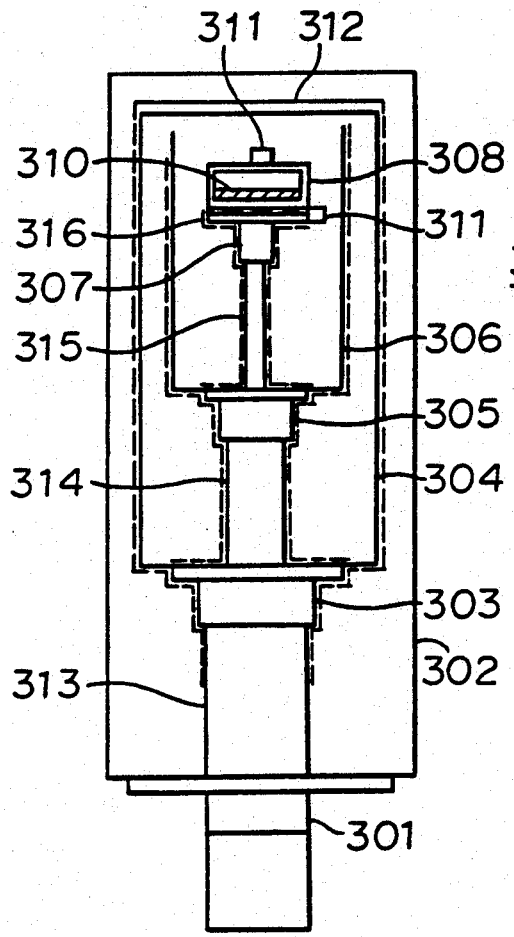
FIGS. 19 and 20 are views similar to FIG. 18, showing various modifications of the SQUID cooling device.
Figure 18:
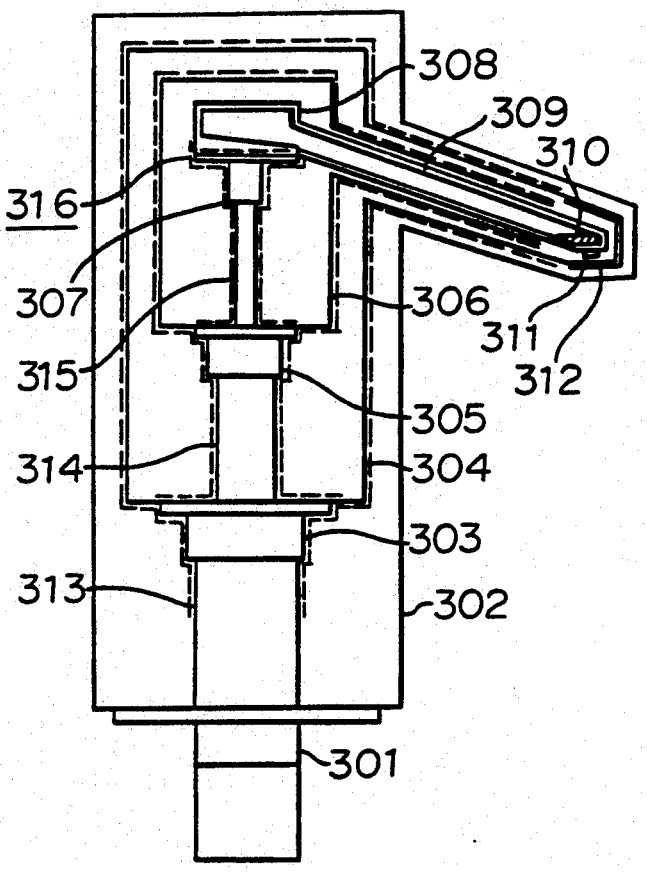
FIG. 18 is a sectional view of a preferred embodiment of SQUID cooling device according to the present invention.
Figure 20:
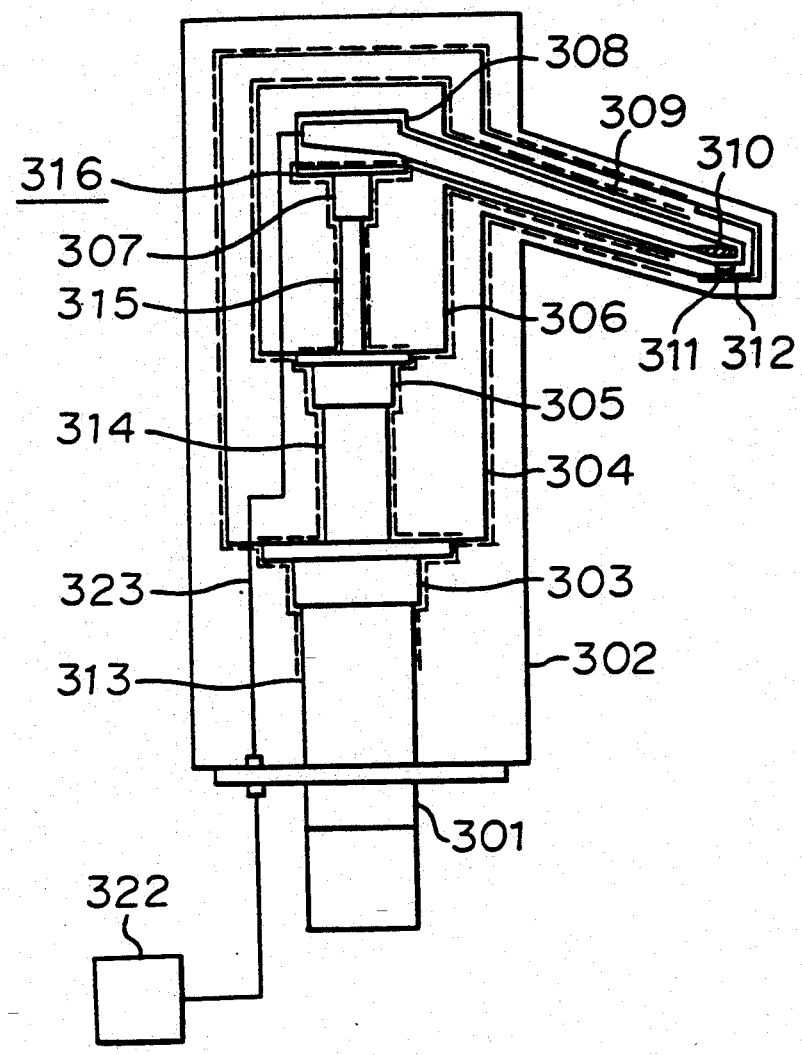

FIGS. 18 to 20 show some preferred embodiments of a SQUID cooling device utilizing the refrigerator according to the present invention, wherein the same reference numerals throughout the drawings denote the same or corresponding parts.

Referring first to FIG. 18, the cooling device includes a refrigerator 301 capable of liquefying helium according to the present invention, a vacuum tank 302 formed of a non-magnetic material such as GFRP, a second thermal shield 306 mounted to a second thermal stage 305, a third thermal stage 307, a helium condenser 308 thermally connected to the third thermal stage 207 for condensing helium 310, a heat pipe 309 for passing liquid and vapor of the helium 310, a SQUID 311 mounted at an end of the heat pipe 311, a thermal shield 312 formed of a non-magnetic material such as alumina so as to well transmit an external signal to the SQUID 311, a third cylinder 315, and a high-temperature superconductor 316 (e.g. yttrium compounds) coated on the outer surface of the cylinders 313, 314 and 315, the thermal stages 303, 305 and 07, and the thermal shields 304 and 306.

When the refrigerator 301 is operated, the first thermal stage 303 is cooled to about 40 K, and the first thermal shield 304 is also cooled to about 40 K. Further, the second thermal stage 305 is cooled to about 11 K, and the second thermal shield 306 is also cooled to about 11 K. When the third thermal stage 307 is cooled to a temperature capable of liquefying the helium 310, the helium 310 starts being liquefied in the helium condenser 308, and the helium 310 liquefied flows down in the non-magnetic heat pipe 309 by the gravity. Thus, the liquefied helium 310 is gathered at the end of the heat pipe 309 to cool the SQUID 311. Under the condition, the high-temperature superconductor 316 is made superconductive and completely diamagnetic to thereby completely shut off a magnetic noise generated in the refrigerator. Further, heat-penetration due to radiation to the heat pipe 309 is reduced by the first thermal shield 304, the second thermal shield 306 and the non-magnetic thermal shield 312. Accordingly, the heat pipe 309 can be used for a considerably long period of time. As the vacuum tank 302 and the thermal shield 312 are formed of non-magnetic materials, a fine magnetic field can be measured by the SQUID 311.

Although the above preferred embodiment employs a single SQUID, the present invention may be applied to a system employing two or more SQUIDs. In the case of using a SQUID operable at high temperatures (e.g. 20 K), the helium 310 may be replaced by hydrogen or neon. Further, the high-temperature superconductor 316 may be replaced by the conventional superconductor.

FIG. 19 shows a modification of the above preferred embodiment, wherein the heat pipe 309 is not used but the SQUIDs 311 are directly mounted to the helium condenser 308 and the third thermal stage 307.

FIG. 20 shows a further modification of the above preferred embodiments, wherein the helium condenser 308 is connected through a pressure control pipe 323 to an external pressure controller 322, so as to control the pressure in the helium condenser 308, thereby further improving a temperature stability.

In the conventional cooling device for SQUID as shown in the 37th Cryogenic Engineering Seminar Text p165, for example, the SQUID is cooled-by the cold fed through a cooling pipe from the refrigerator, so as to avoid a magnetic noise to be generated from the refrigerator. However, such a system requires a compressor and a heat exchanger to cause a complex structure, and there is a possibility of the cooling pipe being choked or the like, causing a reduction in reliability. Additionally, a cooling temperature is affected by a stage temperature and a helium flow quantity to cause unstable operation of the SQUID.

To the contrary, the SQUID cooling devices shown in FIGS. 18 to 20 can completely shut off a magnetic noise generated from the refrigerator by means of the high-temperature superconductor. Further, in the case of using a heat pipe for cooling the SQUID, a degree of freedom of mounting of the SQUID can be made large, and a cooling temperature can be made stable.

FIGS. 21 to 25 show some preferred embodiment of a superconducting computer cooling device utilizing the refrigerator according to the present invention, wherein the same reference numerals throughout the drawings denote the same or corresponding parts.

Figure 21:
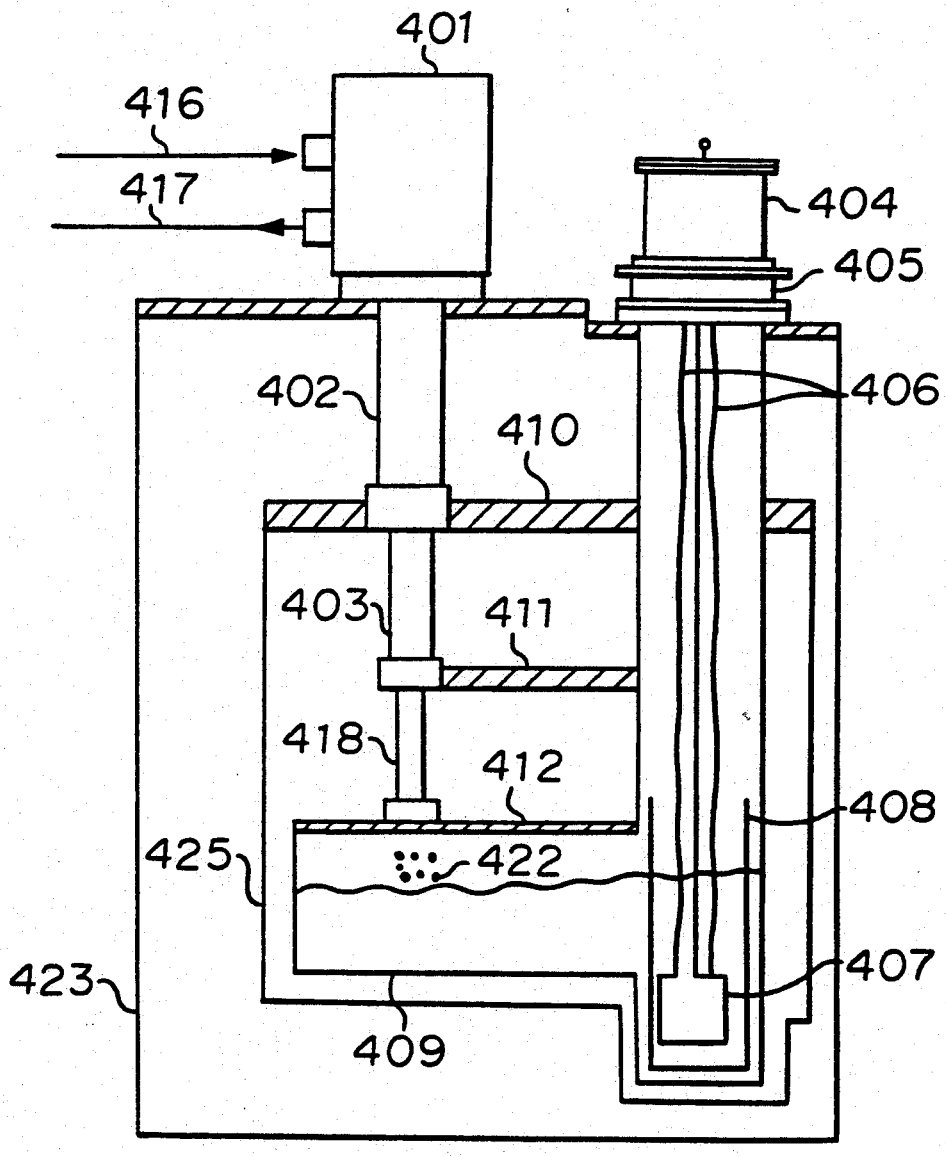
FIG. 21 is a sectional view of a preferred embodiment of the superconducting computer cooling device according to the present invention.

Referring first to FIG. 21, the cooling device includes motor and valve 401 of the GM refrigerator, a first cylinder 402, a second cylinder 403, an interface 404 of the superconducting computer, a gate valve 405, an I/0 cable 406, a logic and memory card 407 formed of a superconductor, a superconducting magnetic shield 408 for protecting the logic and memory card 407 from a magnetic field, a liquid helium bath 409 for containing a liquid helium for cooling the logic and memory card 407, which helium bath also serves as an outlet container for the I/0 cable 406, a first thermal stage 410 of the GM refrigerator, a second thermal stage 411, a third thermal stage 412 for obtaining a temperature cable of liquefying the helium, a helium gas 416 to be supplied to the GM refrigerator, a return gas 417 to be output from the GM refrigerator, a third cylinder 418 of the GM refrigerator which cylinder includes a cold accumulating member formed of GdRh and $Gd_{0.5}Er_{0.5}Rh$, a vacuum tank 423, and a radiation shield tank 425 disposed in the vacuum tank 423.

The liquid helium bath 409 is thermally connected to the first thermal stage 410 and the second thermal stage 411 of the GM refrigerator. The first thermal stage 410 is cooled to about 50 K, and the second thermal stage 411 is then cooled to 10–15 K. Further, the third thermal stage 412 is cooled to about 4.2 K capable of condensing the helium gas. The liquid helium in the helium bath 409 is partially vaporized by heat generation from the logic and memory card 407 of the superconducting computer or heat penetration into the helium bath 409. Then, the helium gas vaporized is cooled and condensed by the third thermal stage 412 to drop into the helium bath 409.

In the conventional cooling device for superconducting computers as mentioned in NBS SPECIAL PUBLICATION 607 p93–102, for example, a JT loop is used. To the contrary, the cooling device of the above preferred embodiment does not require such a JT loop to thereby make the structure sample and compact. Further, it is easy to handle, and it is improved in reliability and service life.

Figure 22:
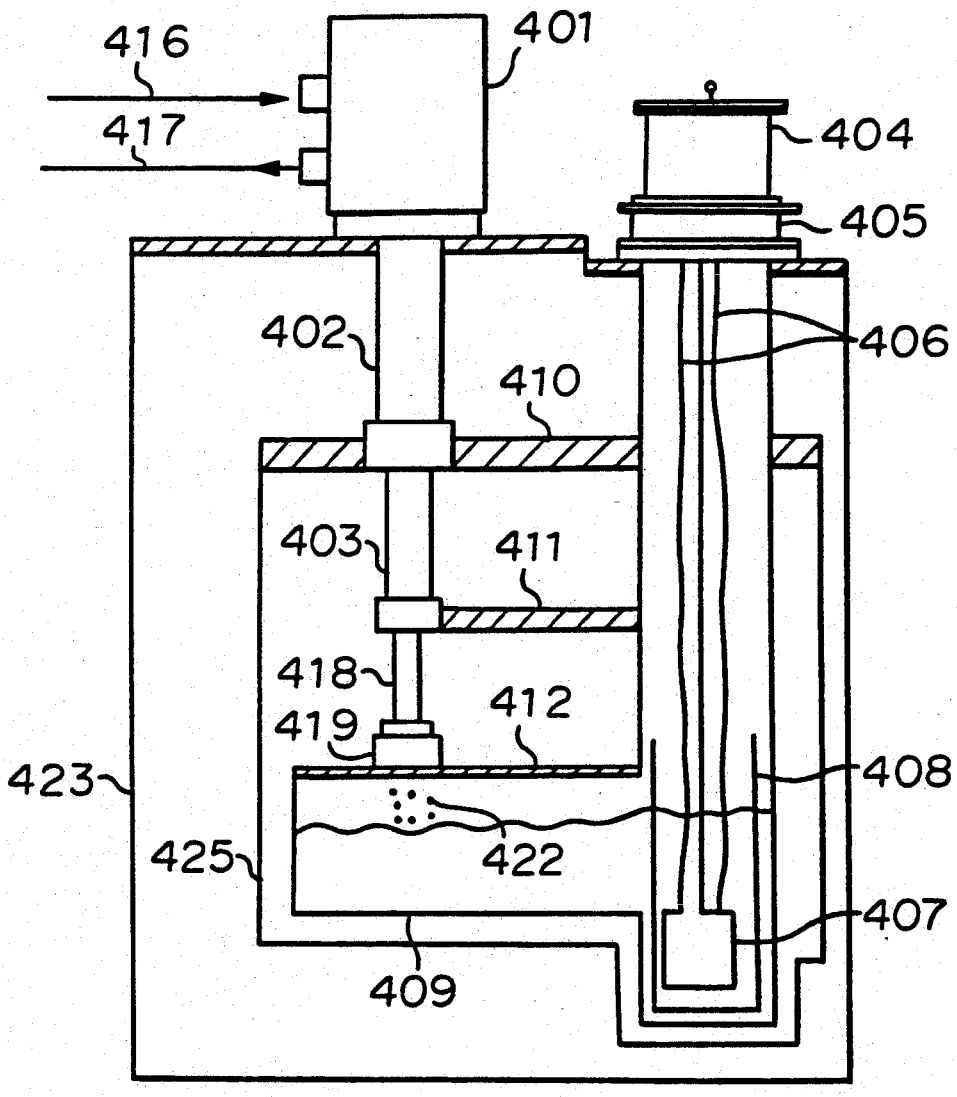
FIGS. 22 to 25 are views similar to FIG. 21, showing various modifications of the superconducting computer cooling device.

FIG. 22 shows a modification of the above preferred embodiment, wherein a helium reservoir 419 enclosing helium is mounted on the third thermal stage 412. Since a specific heat of helium at temperatures near the liquefying temperature of the helium becomes large, the helium reservoir 419 serves to stabilize the temperature of the third thermal stage 412.

Figure 23:
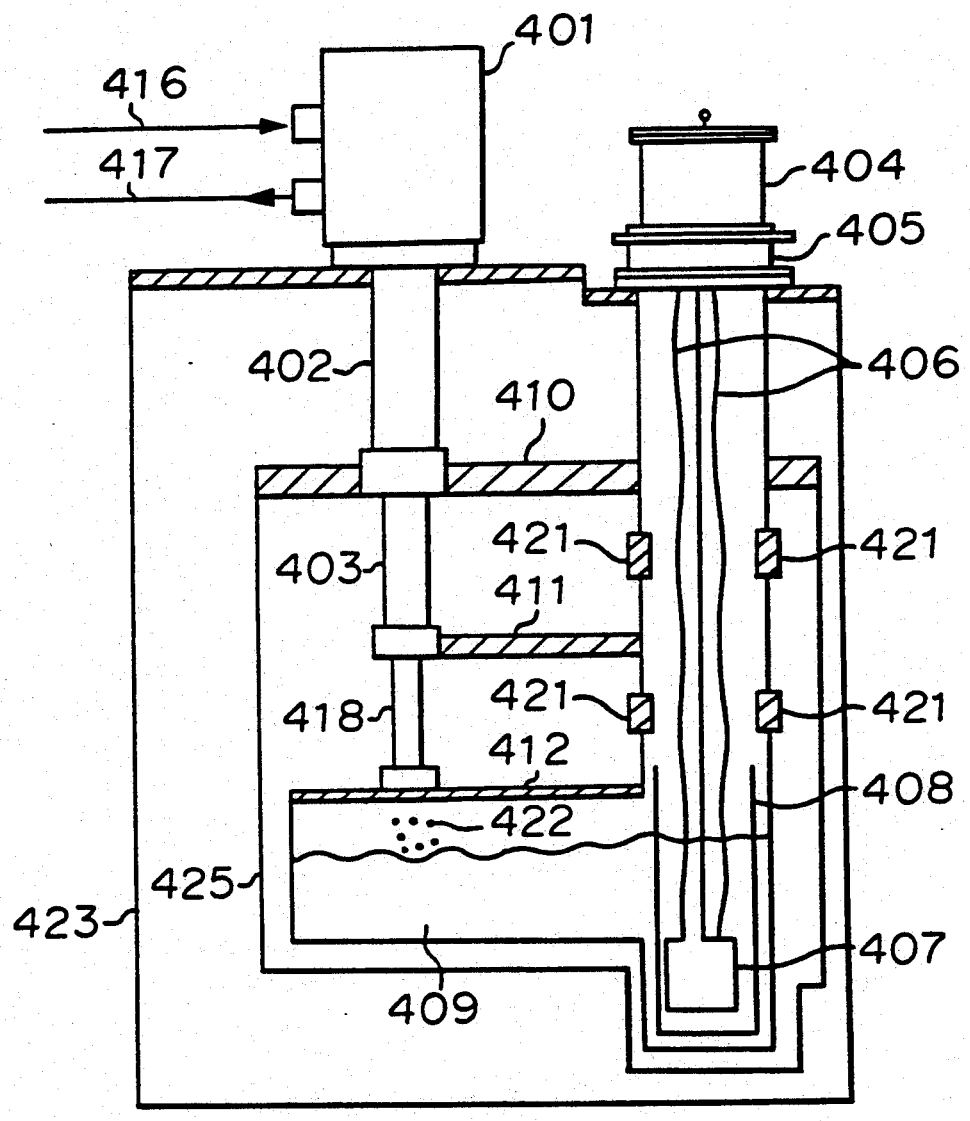

FIG. 23 shows a further modification of the above preferred embodiment, wherein portions of the liquid helium bath 409 between the first and second thermal stages and between the second and third thermal stages are connected together through heat insulators 421 such as GFRP, so as to prevent heat penetration due to conduction from the outside at an ordinary temperature.

Figure 24:
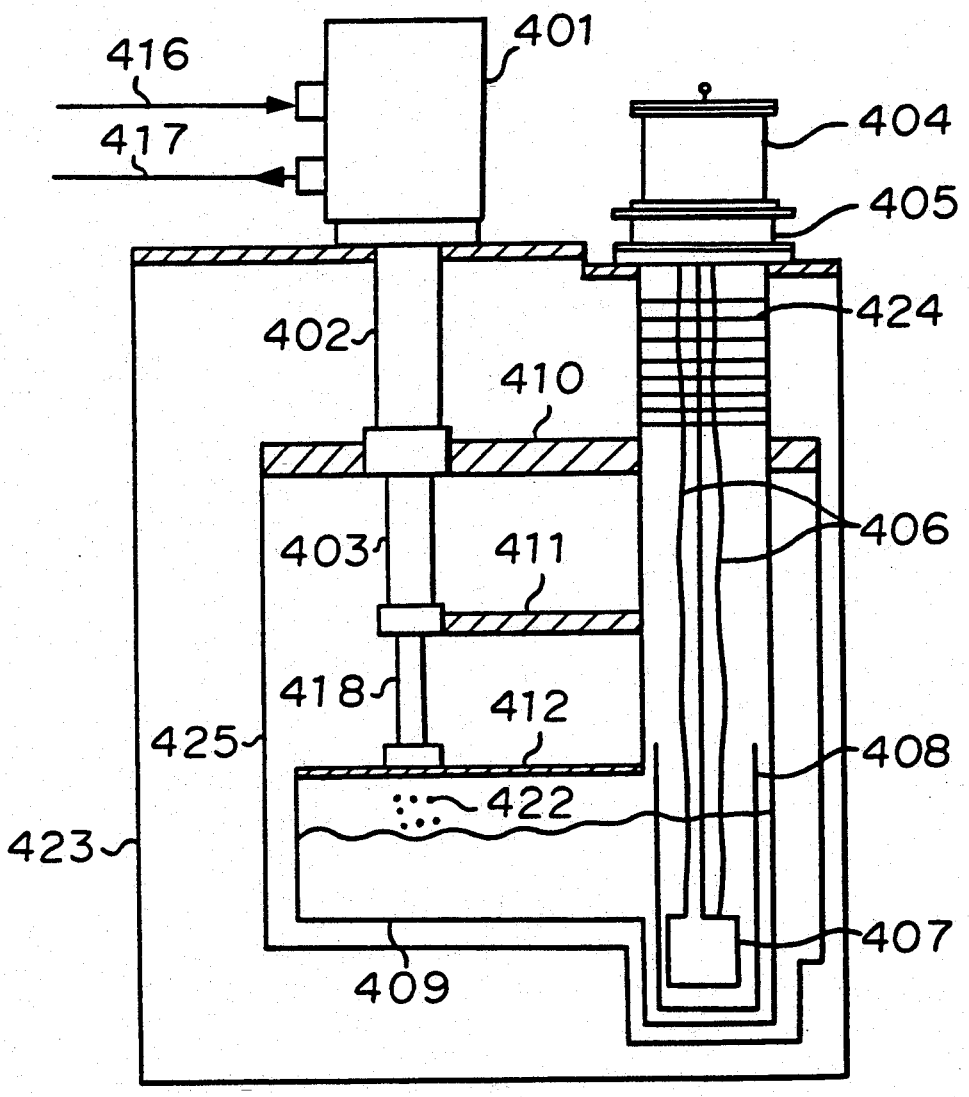

FIG. 24 shows a further modification of the above preferred embodiment, wherein a radiation shield plate 424 formed of copper, for example, is mounted on the liquid helium bath 409, so as to prevent radiation heat.

Figure 25:
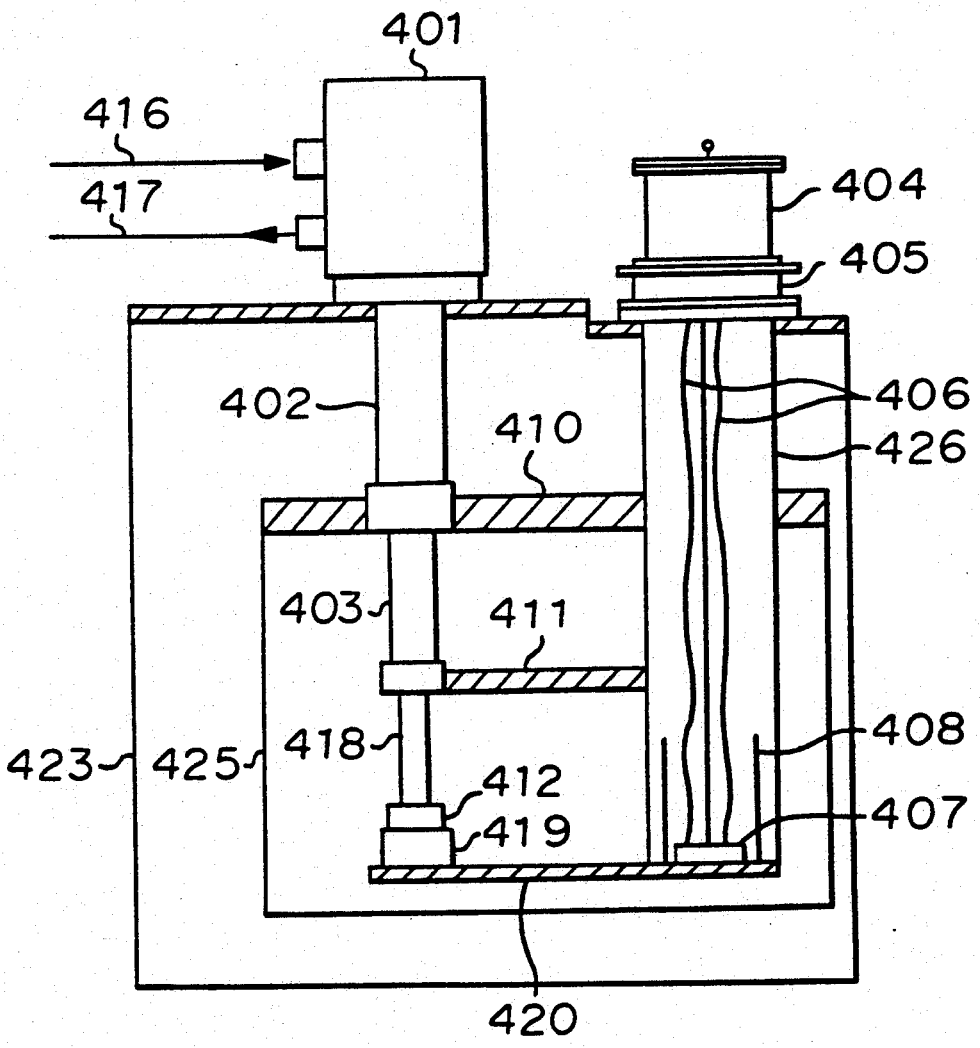

FIG. 25 shows a further modification of the above preferred embodiment, wherein a helium reservoir 419 enclosing helium is mounted to the third thermal stage 412, and a substrate 420 for mounting the logic and memory card 407 is mounted to the helium reservoir 419. An I/O cable outlet container 426 is provided to lead out the I/O cable 406 connected to the logic and memory card 407. The substrate 420 is cooled to a helium liquefying temperature by conduction of the cold from the helium reservoir 419. As a result, the logic and memory card 407 is made operable. Thus, the preferred embodiment does not require the liquid helium bath as shown in FIGS. 21 to 24, thereby reducing the cost and making the structure compact.

Although the above-mentioned preferred embodiments use a three-stage GM refrigerator, the present invention may be applied to any other cold accumulation type refrigerators capable of liquefying helium.

Figure 27:
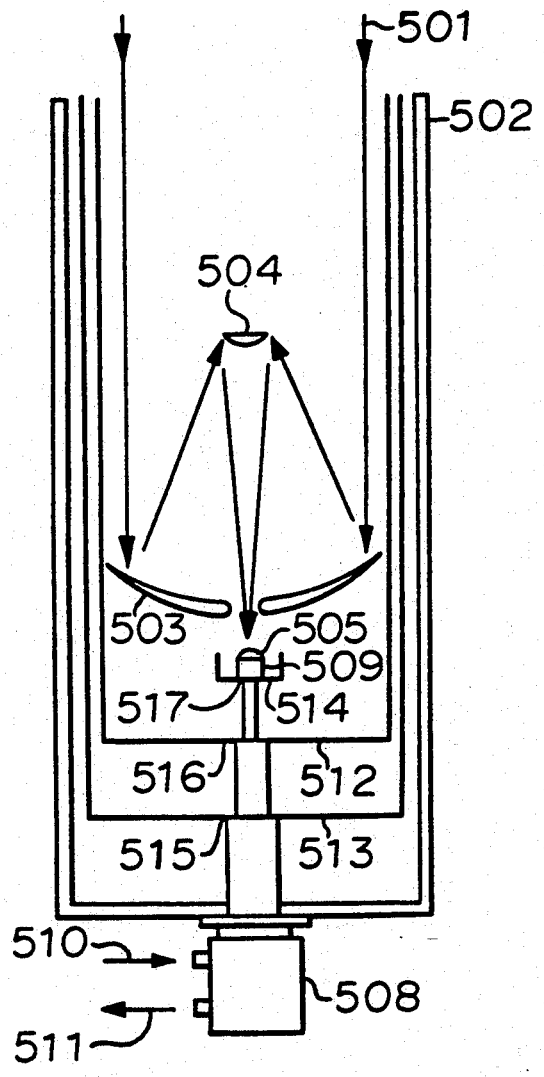
FIGS. 27 and 28 are views similar to FIG. 26, showing various modifications of the infrared telescope cooling device.
Figure 26:
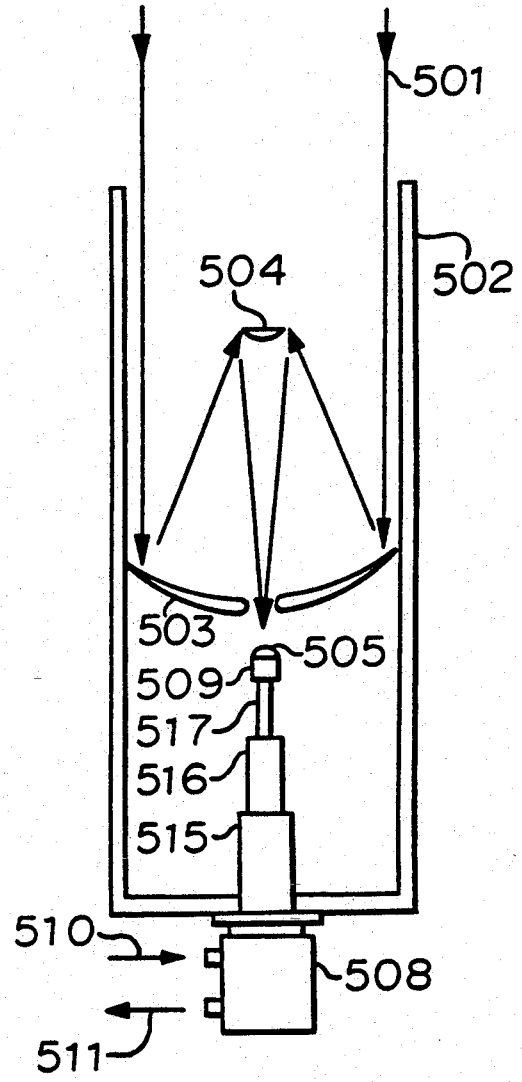
FIG. 26 is a sectional view of a preferred embodiment of the infrared telescope cooling device according to the present invention.
Figure 28:
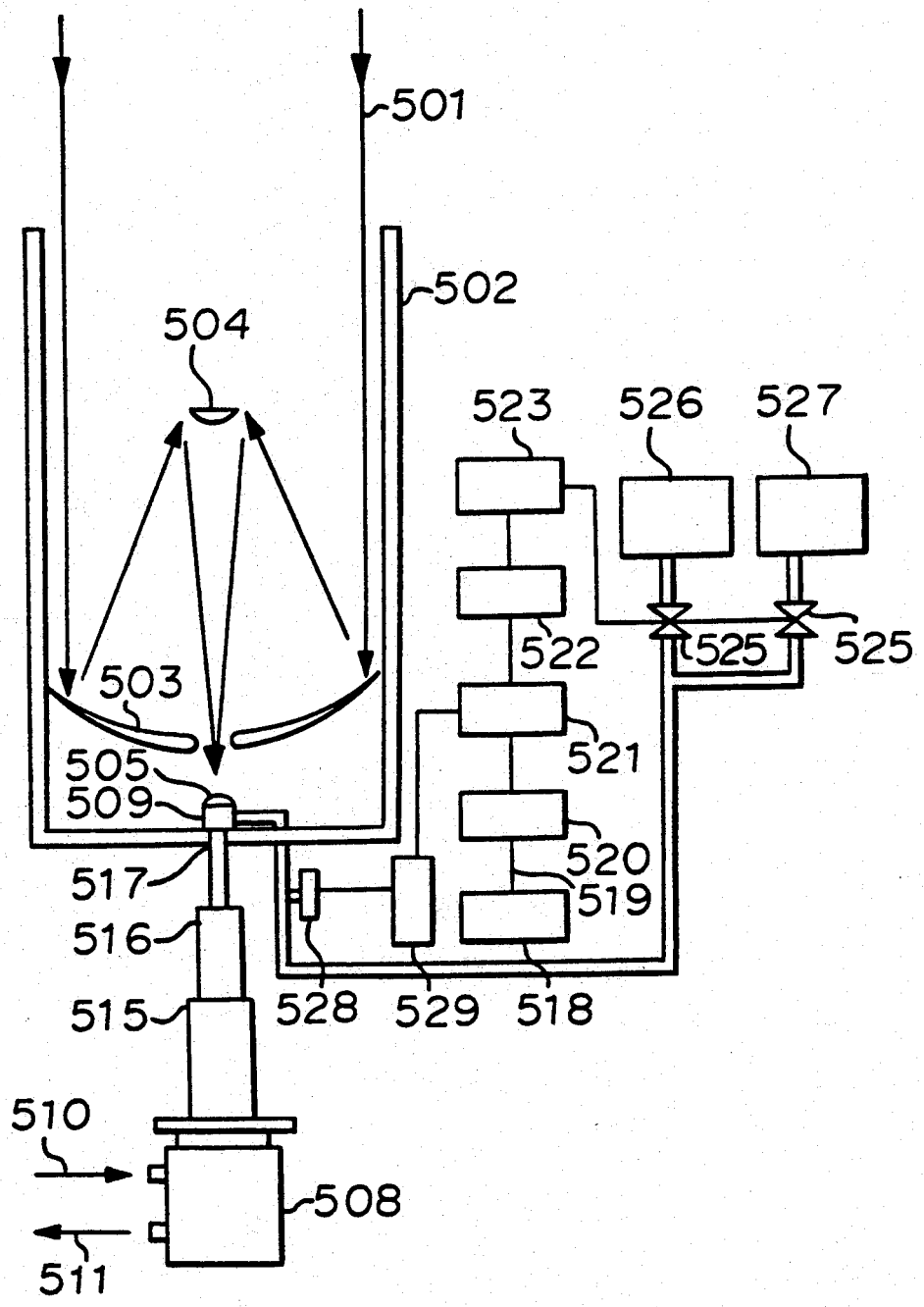
Figure 29:
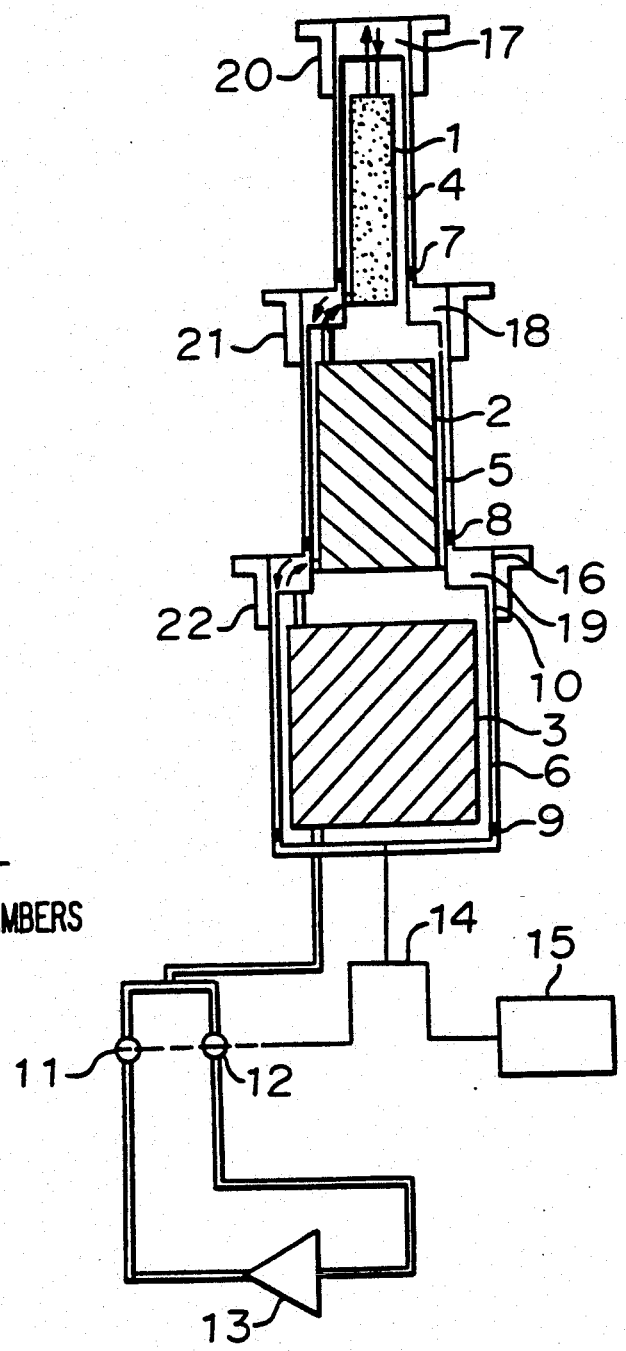
FIG. 29 is a vertical sectional view of the three-stage GM refrigerator in the prior art.
Figure 30:
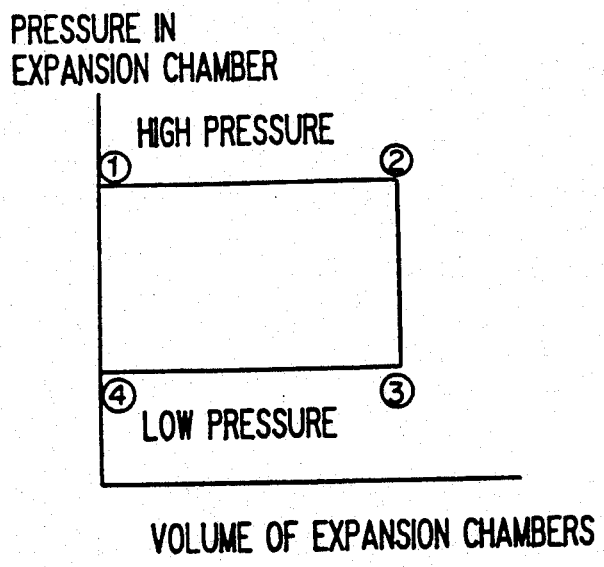
FIG. 30 is a P-V diagram of a refrigeration cycle in the refrigerator shown in FIG. 29.

FIGS. 26 to 28 show some preferred embodiments of an infrared telescope cooling device utilizing the refrigerator according to the present invention, wherein the same reference numerals throughout the drawings denote the same or corresponding parts.

Referring first to FIG. 26, the cooling device includes a case 502, a first reflecting mirror 503 disposed in the case 502 for first reflecting infrared radiation 501 entering the case 502 from the outside, a second reflecting mirror 504 for further reflecting the infrared radiation 501 reflected on the first reflecting mirror 503, an infrared device 505 for receiving the infrared radiation 501 reflecting on the second reflecting mirror 504, a three-stage GM refrigerator 508 capable of attaining temperatures of 2 K to 4.2 K and including a cold accumulating member of a third cold accumulator formed of GdRh and $Gd_{0.5}Er_{0.5}Rh$, for example, a helium reservoir 509 thermally contacting the infrared device 505 and enclosing helium, a helium gas 510 to be supplied to the three-stage GM refrigerator 508, a return gas 511 to be returned from the refrigerator 508, a first thermal stage 515, a second thermal stage 516 and a third thermal stage 517 of the three-stage GM refrigerator 508.

The infrared radiation 501 entering the case 502 from the outside is first reflected on the first reflecting mirror 503, and is then collected to the second reflecting mirror 504. The infrared radiation 501 collected is further reflected on the second reflecting mirror 504, and is then collected to the infrared device 505. On the other hand, the third thermal stage 508 of the three-stage GM refrigerator 508 is cooled to 2 K to 4.2 K, and the helium reservoir 509 thermally contacting the third thermal stage 508 is accordingly cooled to 2 K to 4.2 K. As the specific heat of the helium enclosed in the helium reservoir 509 at this temperature region is large, there is hardly generated temperature oscillation in the helium reservoir 509 even when temperature oscillation is generated in the third thermal stage 517. Therefore, there is hardly generated temperature oscillation in the infrared device 505 thermally contacting the helium reservoir 509, and the infrared device 505 is cooled to 2 K to 4.2 K. Thus, the infrared device 505 is made operable at the temperatures of 2 K to 4.2 K to receive the infrared radiation reflected on the second reflecting mirror 504 and collected to the infrared device 505.

FIG. 27 shows a modification of the above preferred embodiment, wherein a first shield plate 513, a second shield plate 512 and a third shield plate 514 are mounted to the first thermal stage 515, the second thermal stage 516 and the third thermal stage 517, respectively. The first shield plate 513 is cooled to about 50 K by the first thermal stage 515 to function to shield radiation against the second shield plate 512. The second shield plate 512 is cooled to about 15 K by the second thermal stage 516 to function to shield radiation against the third shield plate 514. The third shield plate 514 is cooled to 2–4.2 K by the third thermal stage 517 to function to shield radiation against the infrared device 505. Thus, the radiation heat to the infrared device 505 and the first and second reflecting mirrors 503 and 504 can be reduced.

Referring to FIG. 28 which shows a further modification of the above preferred embodiment, a pressure control system for controlling the pressure in the helium reservoir 509 is connected to the cooling device. The pressure control system includes an input port 518 for inputting a signal for controlling the pressure, a signal line 519 connected to the input port 518, a digital input circuit 520 for receiving the digital signal input from the input port 518 through the signal line 519, a CPU 521 for receiving an input signal from the digital input circuit 520, an output control circuit 522 for receiving an output signal from the CPU 521, an actuator 523 for receiving an output signal from the output control circuit 522, a pressure conduit 524 connected to the helium reservoir 509, a pair Of valves 525A and 525B connected to the pressure conduit 524, a high-pressure tank 526 connected to the valve 525A, and a vacuum tank 527 connected to the valve 525B.

In changing a temperature of the infrared device 505, an input value is input to the input port 518, and it is transmitted through the digital input circuit 520 to the CPU 521. Then, an output signal as a function of temperature is output from the CPU 521. The output control circuit 522 adjusts a magnitude of the output signal from the CPU 521 and outputs an adjusted signal to the actuator 523. Then, the actuator 523 opens and closes the valves 525A and 525B according to a magnitude of the signal from the output control circuit 522.

In the temperature region of 2 K to 4.2 K, the helium in the helium reservoir 509 is in the boiling condition. The lower the pressure of the helium, the lower the boiling point thereof. Therefore, the temperature of the infrared device can be reduced by reducing the pressure of the helium in the helium reservoir 509. That is, the valve 525B connected to the vacuum tank 527 is opened to reduce the pressure of the helium in the helium reservoir 509. The pressure in the helium reservoir 509 is detected by a pressure sensor 528, and an output signal from the pressure sensor 528 is converted to a digital signal by an A/D converter 529. Then, the digital signal is output to the CPU 521. When the pressure becomes a desired pressure, a signal for closing the valve 525B is output from the CPU 521.

In contrast, when the temperature of the infrared device 505 is intended to be increased, the pressure of the helium in the helium reservoir 509 may be increased by opening the valve 525A connected to the high-pressure tank 526.

Thus, the temperature of the infrared device 505 can be desirably controlled in the temperature range of 2 K to 4.2 K.

In the conventional infrared telescope as shown in NEWTON COLLECTION ASTRONOMICAL OBSERVATION (Kyoikusha), a liquid helium tank is required. To the contrary, the infrared telescope according to the present invention does not require such a liquid helium tank, and it is not required to occasionally supply a liquid helium.

While the invention has been described with reference to specific embodiment, the description is illustrative and is not to be construed as limiting the scope of the invention. Various modifications and changes may occur to those skilled in the art without departing from the spirit and scope of the invention as defined by the appended claims.

What is claimed is:

1. A superconducting computer cooling device comprising a liquid helium bath, liquid helium contained in said liquid helium bath, a logic and memory card formed of a superconductor, said logic and memory card being immersed in said liquid helium, and a multi-stage cold accumulation type refrigerator having a plurality of thermal stages for condensing helium vaporized from said liquid helium, wherein said multi-stage cold accumulation type refrigerator comprises a compressor disposed at an ordinary temperature, a helium gas as a common operating fluid to be compressed by said compressor, a plurality of thermal stages, at least one cylinder, and one or more expansion chambers and cold accumulators of different temperature levels, said thermal stages and said cylinders having outer surfaces, the improvements wherein at least one of said expansion chambers has a seal to prevent leakage to said helium gas, said seal being capable of sliding, wherein sliding resistance of said seal generates less heat than the theoretical generated refrigeration quantity of said expansion chamber, said theoretical generated refrigeration quantity being based on isothermal expansion in said expansion chamber; and a cold accumulating member of said cold accumulators is formed of an alloy or compound containing a rare earth metal.

2. The superconducting computer cooling device of claim 1, wherein the final thermal stage comprises a first cold accumulating member at a high temperature level formed from GdRh, and a second cold accumulating member at a lower temperature formed of $Gd_{0.5}Er_{0.5}Rh$, wherein said GdRh is present in a weight percentage of 45–65%, based on the total amount of GdRh and $Gd_{0.5}Re_{0.5}Rh$.

3. A superconducting computer cooling device comprising logic and memory cards formed of a superconductor, a substrate for mounting said logic and memory cards, a multi-stage cold accumulation type refrigerator capable of generating a temperature of 4.2 K or less, having a plurality of thermal stages for cooling said logic and memory cards, a compressor disposed at an ordinary temperature, a helium gas as a common operating fluid to be compressed by said compressor, a plurality of thermal stages, at least one cylinder, and one or more expansion chambers and cold accumulators of different temperature levels, said thermal stages and said cylinders having outer surfaces, the improvements wherein at least one of said expansion chambers has a seal to prevent leakage of said helium gas, said seal being capable of sliding, wherein sliding resistance of aid seal generates less heat than the theoretical generated refrigeration quantity of said expansion chamber, said theoretical generated refrigeration quantity being based on isothermal expansion in said expansion chamber; and a cold accumulating member of said cold accumulators is formed of an alloy or compound containing a rare earth metal.

4. The superconducting computer cooling device of claim 3, wherein the final thermal stage comprises a first cold accumulating member at a high temperature level formed from GdRh, and a second cold accumulating member at a lower temperature formed of $Gd_{0.5}Er_{0.5}Rh$, wherein said GdRh is present in a weight percentage of 45–65%, based on the total amount of GdRh and $Gd_{0.5}Er_{0.5}Rh$, and a helium reservoir formed in said final thermal stage.

5. The superconducting computer cooling device of claim 1 or 3, wherein said seal comprises a piston ring and a tension ring.

6. The superconducting computer cooling device of claim 1 or 3, wherein said seal is a labyrinth seal.

7. The superconducting computer cooling device of claim 1 or 3, wherein said expansion chamber has an inner wall and an outer wall, and said seal slides between said inner wall and said outer wall.

8. The superconducting computer cooling device of claim 7, wherein said inner wall has a surface roughness of about 3 $\mu$m RMS or less.

9. The superconducting computer cooling device of claim 3, wherein said heat generated by said sliding resistance of said seal is 4% of said theoretical generated refrigeration quantity of said expansion chamber.

10. The superconducting computer cooling device of claim 1 or 3, further comprising a magnet provided at the outlet of said cold accumulator, for trapping a fine powder expelled from said cold accumulating member.

11. The superconducting computer cooling device of claim 1 or 3, further comprising a magnet in the center of said cold accumulator, to suppress a fine powder of said cold accumulating members from being expelled.

12. The superconducting computer cooling device of claim 1 or 3, wherein said multi-stage cold accumulation type refrigerator further comprises a thermal anchor mounted on said outer surface of said cylinder at a location corresponding to the position where said seal slides, said thermal anchor being formed of a good heat conductor and being thermally connected to a high-temperature thermal stage.

13. The superconducting computer cooling device of claim 3, wherein said multi-stage cold accumulation type refrigerator further comprises a second cylinder of said cold accumulators, or is disposed below said second cold accumulating member, a container for containing helium mounted to an end of one of said cylinders of said cold accumulators, or is disposed below said second cold accumulating member, so as to reduce a temperature change in a refrigeration cycle.

* * * * *